US008326178B2

(12) United States Patent
Nakamura et al.

(10) Patent No.: US 8,326,178 B2
(45) Date of Patent: Dec. 4, 2012

(54) COVERING MEMBER AND CARTRIDGE

(75) Inventors: Yuuki Nakamura, Suntou-gun (JP); Yoshifumi Takeyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 385 days.

(21) Appl. No.: 12/546,150

(22) Filed: Aug. 24, 2009

(65) Prior Publication Data

US 2010/0054799 A1 Mar. 4, 2010

(30) Foreign Application Priority Data

Sep. 1, 2008 (JP) ..... 2008-223400
Jul. 17, 2009 (JP) ..... 2009-168888

(51) Int. Cl.
*G03G 21/18* (2006.01)
*G03G 15/02* (2006.01)
*G03G 15/08* (2006.01)

(52) U.S. Cl. ..... 399/114; 399/115; 399/116; 399/234

(58) Field of Classification Search ..... 399/114–117, 399/234, 411
See application file for complete search history.

(56) References Cited

U.S. PATENT DOCUMENTS 5,666,608 A * 9/1997 Christensen ..... 399/176
5,878,304 A * 3/1999 Watanabe et al. ..... 399/92
7,577,378 B2 8/2009 Matsui
2004/0126135 A1* 7/2004 Kanno et al. ..... 399/114
2008/0292331 A1 11/2008 Yokomori et al. ..... 399/27

FOREIGN PATENT DOCUMENTS

JP 05-232752 9/1993
JP 2000-181328 6/2000
JP 2000181328 A * 6/2000
JP 2001-282079 10/2001
JP 2004-280012 10/2001
JP 2001-337511 12/2001
JP 2005-37462 2/2005
JP 2007-271759 10/2007

OTHER PUBLICATIONS

Office Action in Japanese Patent Application No. 2009-168888, dated Aug. 3, 2010, with English translation.

* cited by examiner

*Primary Examiner* — Joseph S Wong
(74) *Attorney, Agent, or Firm* — Fitzpatrick, Cella, Harper & Scinto

(57) ABSTRACT

A cartridge detachably mountable to a main assembly of an electrophotographic image forming apparatus, includes an image bearing member; a frame; process means contactable to and actable on the image bearing member; a covering member detachably mounted to the frame to protect a surface of the image bearing member; and a spacing portion provided on the covering member and inserted between the image bearing member and the process means to space the image bearing member and the process means from each other, the spacing portion being movable relative to the covering member while being interposed between the image bearing member and the process means when the covering member is removed from the frame.

20 Claims, 27 Drawing Sheets

COVERING MEMBER AND CARTRIDGE

FIELD OF THE INVENTION AND RELATED ART

The present invention relates to a covering member and a cartridge.

Here, a cartridge means a cartridge for an electrophotographic image forming apparatus. It is such a cartridge that integrally contains at least an image bearing member, and one of the processing means which process the image bearing member. It is structured so that it is removably mountable in the main assembly of the electrophotographic image forming apparatus.

A covering member means a member for covering the abovementioned image bearing member to protect the image bearing member until a cartridge is used for the first time, in particular, while the cartridge which has never been used is transported. It is removably attachable to a cartridge.

An electrophotographic image forming apparatus is an apparatus which forms an image on recording medium, with the use of an electrophotographic image forming method. It includes an electrophotographic copying machine, an electrophotographic printer (laser beam printer, LED printer, etc.), a facsimile apparatus, a wordprocessor, and a multifunction image forming apparatus made up of two or more of the preceding apparatuses, etc., for example.

The main assembly of an electrophotographic image forming apparatus means what remains after the removal of all cartridges from an electrophotographic image forming apparatus.

An electrophotographic image forming apparatus, such as a copying machine, a printer, and a facsimile apparatus (which hereafter will be referred to simply as image forming apparatus) forms an electrostatic latent image on its image bearing member (electrophotographic photosensitive member), and makes the electrostatic latent image visible to human eye by developing the electrostatic latent image with the use of its developing means.

In the field of an image forming apparatus employing an electrophotographic image forming process, it has been a common practice to employ a cartridge system, which integrally places an image bearing member, and one or more processing means for processing the image bearing member, in a cartridge which is removably mountable in the main assembly of an image forming apparatus. The employment of this cartridge system makes it possible for a user to maintain an image forming apparatus by him- or herself, that is, without relying on a service person. Thus, the employment of the cartridge system can drastically improve an electrophotographic image forming apparatus in operational efficiency. This is why the cartridge system has been widely used in the field of an electrophotographic image forming apparatus.

Some cartridges have a development unit and a drum unit. A development unit is the unit which has a developing means. A drum unit has a photosensitive drum, which is an image bearing member.

A drum unit has: a photosensitive drum; a charging means for charging the photosensitive drum; and a drum unit frame by which the photosensitive drum and charging means are supported. One of the methods used by an image forming apparatus is a contact charging method, which charges the peripheral surface of a photosensitive drum by being placed in contact with the photosensitive drum. In the case of the image forming apparatus in the following preferred embodiments of the present invention, a charge roller, which is placed in contact with the peripheral surface of a photosensitive drum is used, as a charging means for charging the peripheral surface of the photosensitive drum. In order to ensure that a charge roller remains in contact with a photosensitive drum, the charge roller is supported by the drum unit frame so that it is kept pressed toward the photosensitive drum. Thus, if a conventional cartridge is left unused for a long time, the charge roller remains pressed upon the photosensitive drum for a long time, making it possible for the charge roller to permanently deform.

Disclosed in Patent Document 1 is one of the known solutions to the above-described problem. According to the document, a drum cartridge is structured to keep its charge roller separated from its photosensitive drum until the cartridge is placed in the hands of a user, that is, until the cartridge is put to use for the first time, in particular, during the commercial distribution of the cartridge.

More concretely, in the case of the structural arrangement disclosed in Patent Document 1, before the cartridge is shipped out from a factory, warehouse, or the like, a spacer is inserted between the charge roller and photosensitive drum through the covering member for the photosensitive drum, in order to separate, and keep separated, the charge roller from the photosensitive drum.

One of the development methods used in the field of an image forming apparatus is a contact developing method, which is such a developing method that keeps a developing means in contact with an image bearing member while an electrostatic latent image formed on the image bearing member is developed with developer. In the case of the image forming apparatus in the following preferred embodiments of the present invention, a development roller is used as the developing means.

A contact developing method is problematic in that if a cartridge is left unused for a long time, with its development roller left in contact with its photosensitive drum, it is possible for the development roller to deform.

As one of the means for solving this problem, it has been known to structure an image forming apparatus in such a manner that when a cartridge is in the main assembly, its development roller is kept separated from its photosensitive drum unless the image forming apparatus is forming an image (Patent Document 2). That is, the main assembly of the image forming apparatus is provided with a mechanism for separating, and keeping separated, the development roller from the photosensitive drum. Thus, when a process cartridge is in its image forming position in the apparatus main assembly, the abovementioned development roller separating mechanism continuously presses the development unit unless the image forming apparatus is forming an image, causing the development unit to move relative to the drum unit. Therefore, unless the image forming apparatus is forming an image, the development roller remains separated from the photosensitive drum.

Another solution to the above described problem is disclosed in Patent Document 3. According to this document, a cartridge is provided with a member for covering the photosensitive drum, and the covering member is provided with a portion for separating, and keeping separated, the development unit from the photosensitive member unit. Thus, until the cartridge is delivered to a user, that is, until the cartridge is put to use for the first time, in particular, during the commercial distribution of the cartridge, the development unit separating portion remains inserted between the development unit and photosensitive member unit to keep the development roller separated from the photosensitive drum while the process cartridge is not used for an actual image forming operation.

Patent Document 1: Japanese Laid-open Patent Application 2000-181328

Patent Document 2: Japanese Laid-open Patent Application 2001-337511

Patent Document 3: Japanese Laid-open Patent Application H05-232752

In the case of the above described solutions, the charging member separating member (which is kept inserted between the charge roller and photosensitive drum), or the development unit separating member (separating portion) (with which covering member of photosensitive member unit is provided, and which is kept inserted between development unit and photosensitive unit), is removed to allow the development roller or charge roller to come into contact with the photosensitive drum.

In a case where the direction in which the covering member is removed is different from the direction in which the separating member was inserted between the development roller and photosensitive drum, or between the charge roller and photosensitive drum, it is possible that when the covering member is removed, an unexpectedly large amount of force will be required, and/or the separating portion, photosensitive drum, etc., will be damaged. One of the solutions to this problem is to make the separating member independent from the covering member. However, this solution requires a user to perform two independent operations to ready the cartridge for image formation, adding to the number of the operations which must be performed by a user to prepare the process cartridge for image formation.

SUMMARY OF THE INVENTION

Thus, the present invention relates to a cartridge provided with a covering member which is for protecting the peripheral surface of the image bearing member of the cartridge and has a separating portion for keeping the processing means of the cartridge separated from the image bearing member of the cartridge, and its primary object is to improve the cartridge in usability by making it easier to remove the covering member.

Another object of the present invention relating to a cartridge provided with a covering member which is for protecting the peripheral surface of the image bearing member of the cartridge and has a separating portion for keeping the processing means of the cartridge separated from the image bearing member of the cartridge, is to reduce the amount of force necessary to remove the covering member.

Another object of the present invention relating to a cartridge provided with a covering member which is for protecting the peripheral surface of the image bearing member of the cartridge and has a separating portion for keeping the processing means of the cartridge separated from the image bearing member of the cartridge, is to prevent the image bearing member and processing means from being damaged when the covering member is removed.

According to an aspect of the present invention, there is provided a cartridge detachably mountable to a main assembly of an electrophotographic image forming apparatus, said cartridge comprising an image bearing member; a frame; process means contactable to and actable on said image bearing member; a covering member detachably mounted to said frame to protect a surface of said image bearing member; and a spacing portion provided on said covering member and inserted between said image bearing member and said process means to space said image bearing member and said process means from each other, said spacing portion being movable relative to said covering member while being interposed between said image bearing member and said process means when said covering member is removed from said frame.

According to another aspect of the present invention, there is provided a covering member for use with a cartridge detachably mountable to a main assembly of an electrophotographic image forming apparatus, the electrophotographic image forming apparatus including an image bearing member, a frame, process means contactable to and actable on the image bearing member, said covering member being, detachably mounted to said frame to protect a surface of said image bearing member, said, covering member comprising a spacing portion provided on said covering member and inserted between said image bearing member and said process means to space said image bearing member and said process means from each other, said spacing portion being movable relative to said covering member while being interposed between said image bearing member and said process means when said covering member is removed from said frame.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

[Embodiment 1]

(Overall Structure of Image Forming Apparatus)

First, referring to FIG. 4, the overall structure of the electrophotographic image forming apparatus in this embodiment will be described. This image forming apparatus is a full-color laser beam printer, which uses an electrophotographic process, and uses four primary colors. That is, this image forming apparatus forms an image on a sheet 40 of transferring medium (recording medium: paper, OHP sheet, label, etc.), in response to image signals inputted into its control circuit portion (unshown) from a host apparatus (unshown), such as a personal computer, an image reader, a facsimile apparatus (on transmitting side). The control circuit portion (controlling means: CPU) exchanges various electrical information with the host apparatus or control portion (unshown). It also oversees the image forming operation carried out by the image forming apparatus, based on preset control programs and reference tables. In other words, the image forming operation carried out by the image forming operation, which will be described next, is controlled by the control circuit portion.

Figure 4A:
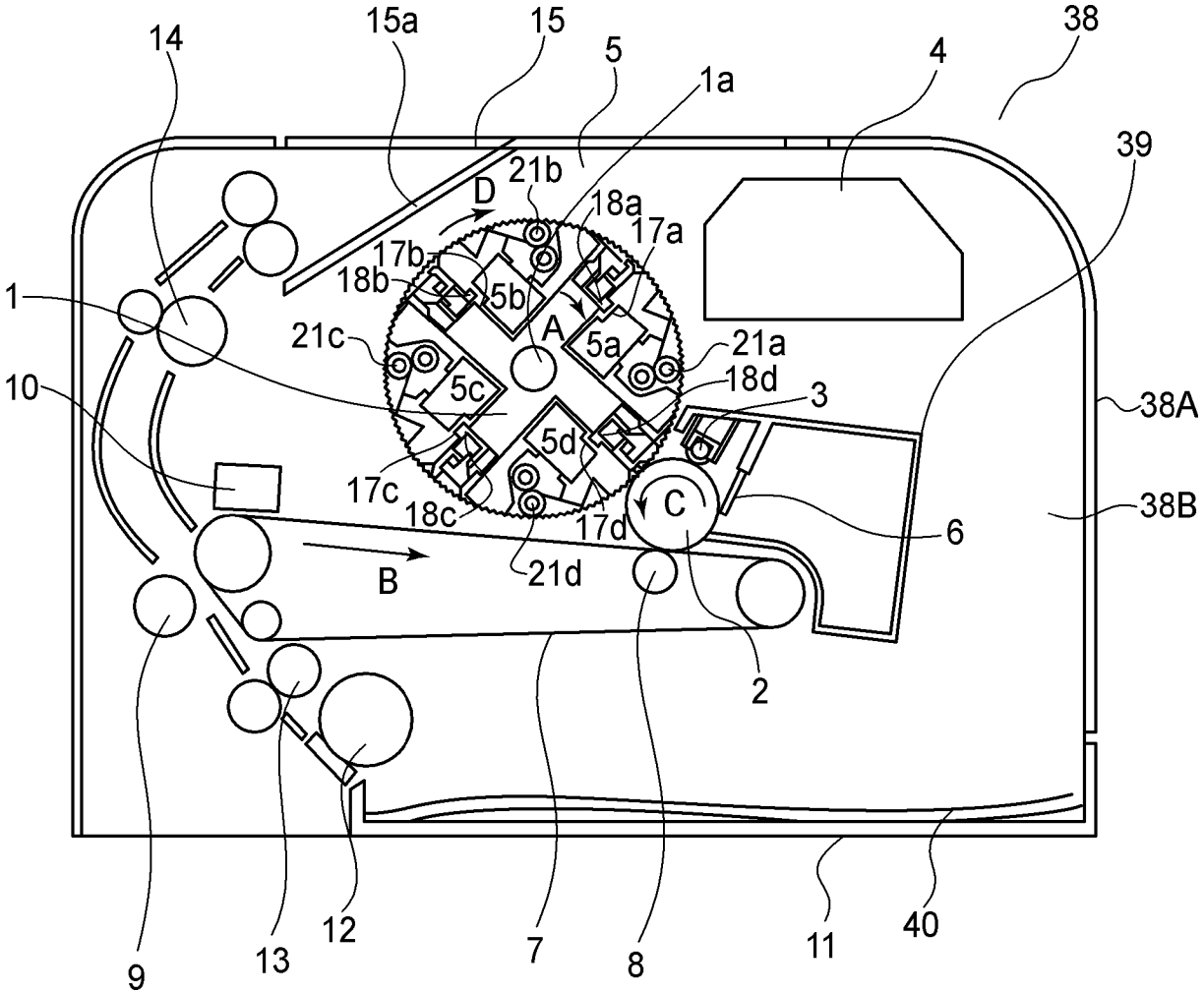
FIGS. 4A and 4B are schematic cross-sectional views of the image forming apparatus in the first preferred embodiment of the present invention.

Referring to FIG. 4A, this image forming apparatus 38 has a photosensitive drum 2 as an image bearing member. It also has: a charging means 3 for uniformly charging the photosensitive drum 2; an exposing means 4 for forming a latent image by projecting a beam of laser light upon the photosensitive drum 2; and a developing means 5 for developing the latent image into an image visible to human eye, with the use of developer (visible powdery substance, which hereafter will be referred to as toner). The charging means 3, exposing means, and developing means 5 are disposed in the adjacencies of the peripheral surface of the photosensitive drum 2 in a manner of surrounding the peripheral surface. The image forming apparatus 38 is also provided with a cleaning means 6 for removing the residual toner on the photosensitive drum 2. The developing means 5 in this embodiment is of the so-called rotary type, and uses four toners different in color. That is, it develops the latent image formed on each photosensitive drum 2, into a visible image, with the use of a color toner, which corresponds in color to the latent image. It has four developing apparatuses, which are a yellow developing apparatus 5*a*, a magenta developing apparatus 5*b*, a cyan developing apparatus 5*c*, and a black developing apparatus 5*d*.

In this embodiment, the photosensitive drum 2, charging means 3, and cleaning means 6 are integrally disposed in a cartridge, which is removably mountable in a preset space (unshown) in the main assembly 38*a* of the image forming apparatus; the photosensitive drum 2, charging means 3, cleaning means 6, and cartridge make up a drum cartridge 39. However, it is not mandatory that the drum cartridge 39 has the cleaning means 6. That is, the drum cartridge 39 is a cartridge which has at least an image bearing member (photosensitive drum) and a charging means for charging the image bearing member, and is removably mountable in the main assembly of an electrophotographic image forming apparatus.

The developing means 5 has the yellow developing apparatus 5*a*, magenta developing apparatus 5*b*, cyan developing apparatus 5*c*, and black developing apparatus 5*d*, and a rotary 1, in which the preceding developing apparatuses 5*a*, 5*b*, 5*c*, and 5*d* are sequentially disposed in the listed order, in terms of the circumferential direction of the rotary. The rotary 1 is rotationally supported by the apparatus main frame 38B. The yellow developing apparatus 5*a*, magenta developing apparatus 5*b*, cyan developing apparatus 5*c*, and black developing apparatus 5*d* may be permanently fixed to the rotary 1, or may be made in the form of a development cartridge so that they can be removably mountable in the rotary 1. In this embodiment, the yellow developing apparatus 5*a*, magenta developing apparatus 5*b*, cyan developing apparatus 5*c*, and black developing apparatus 5*d* are in the form of a development cartridge, which is removably mountable in the rotary 1. Hereafter, the yellow developing apparatus 5*a*, magenta developing apparatus 5*b*, cyan developing apparatus 5*c*, and black developing apparatus 5*d* will be referred to as the yellow development cartridge 5*a*, magenta development cartridge 5*b*, cyan development cartridge 5*c*, and black development cartridge 5*d*, respectively.

The yellow development cartridge 5*a*, magenta development cartridge 5*b*, cyan development cartridge 5*c*, and black development cartridge 5*d* are the same in the structural arrangement with which they are supported by the rotary 1. Thus, the structural arrangement with which the development cartridges 5*a*, 5*b*, 5*c*, and 5*d* are supported by the rotary 1 will be described with reference to the yellow development cartridge 5*a*.

As the yellow development cartridge 5*a* is mounted into the rotary 1, the cartridge securing portion 17*a*, with which the yellow development cartridge 5*a* is provided, engages with the develop apparatus retaining portion 18*a*, with which the rotary 1 is provided. Thus, the yellow development cartridge 5*a* is prevented from falling out of the rotary 1. The development apparatus retaining member 18*a* remains pressed by a spring (unshown) in the direction indicated by an arrow mark A, that is, the direction to keep the development apparatus retaining member 18*a* engaged with the yellow development cartridge 5*a*. The magenta development cartridge 5*b*, cyan development cartridge 5*c*, and black development cartridge 5*d* also are provided with cartridge securing portions 17*b*, 17*c*, and 17*d*, which engage with the developing apparatus retaining members 18*b*, 18*c*, and 18*d*, respectively, with which the rotary 1 is provided. Thus, they are prevented from falling out of the rotary 1.

First, the photosensitive drum 2 is rotated in the direction indicated by an arrow mark C, in synchronism with an intermediary transfer belt 7, which is rotated in the direction indicated by an arrow mark B, while the peripheral surface of the photosensitive drum 2 is charged by the charging means 3. Then, the charge portion of the peripheral surface of the photosensitive drum 2 is irradiated with the exposing means 4 to form an electrostatic latent image which corresponds to the yellow component of an intended full-color image, on the photosensitive drum 2.

Figure 4B:
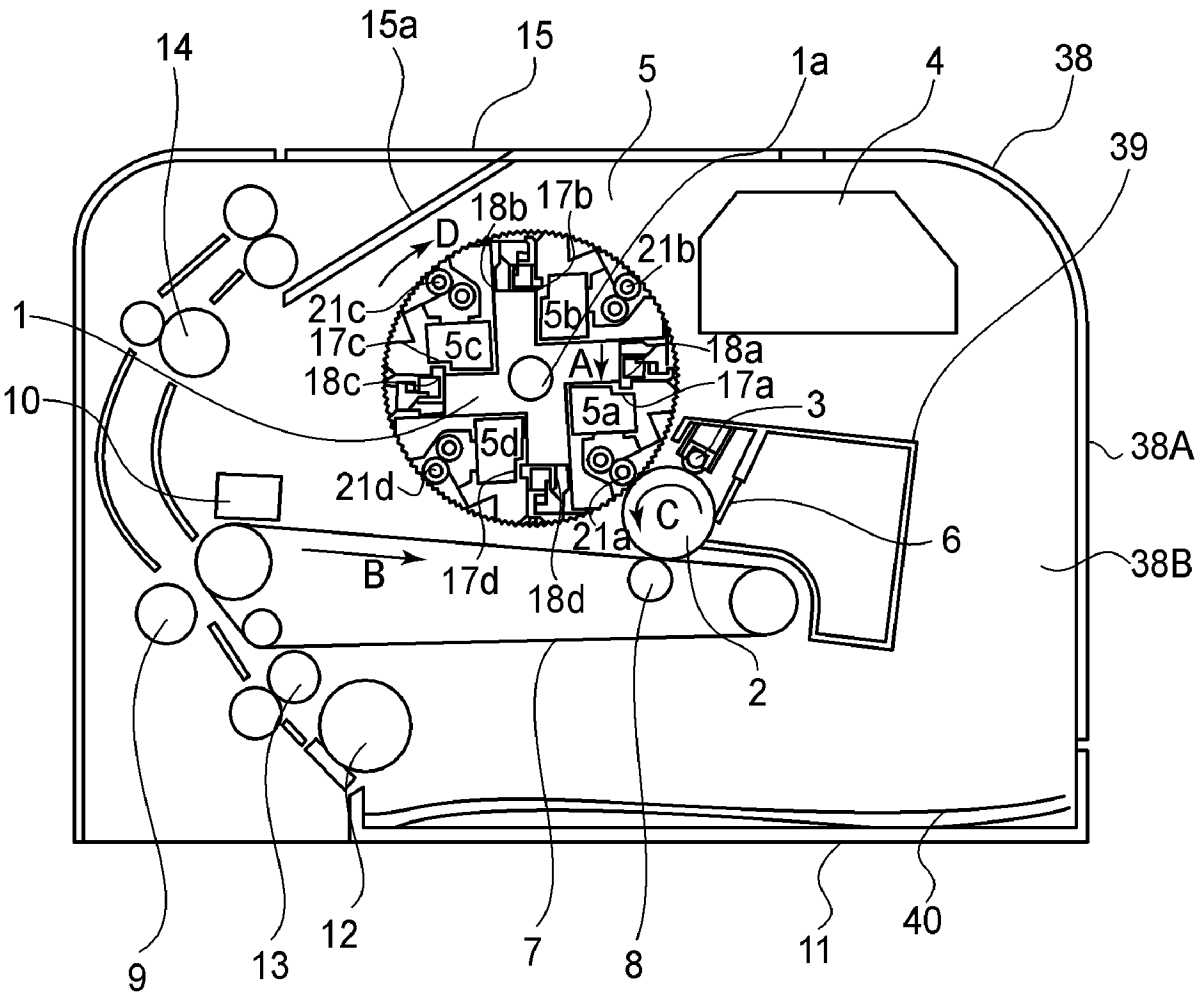

At the same time as the formation of this electrostatic latent image, the rotary 1 is rotated by a preset angle about the rotational axis 1*a* of the rotary 1 in the direction indicated by an arrow mark D by a driving force transmission mechanism (unshown). As a result, the yellow development cartridge 5*a* is moved into its development position, in which it opposes the photosensitive drum 2, and is precisely position in the development position. That is, the rotary 1 is rotated so that the development roller 21*a* of the yellow development cartridge 5*a* opposes the photosensitive drum 2 in a preset manner, as shown in FIG. 4B.

Then, a difference in potential level is provided between the photosensitive drum 2 and development roller 21*a* of the yellow development cartridge 5*a* so that yellow toner adheres to the latent image which has just been formed on the photosensitive drum 2. As a result, the yellow toner adheres to the latent image on the photosensitive drum 2; the latent image is developed. That is, a yellow image is formed of the yellow toner, on the photosensitive drum 2.

Thereafter, the visible image formed of the yellow toner (which hereafter will be referred to as yellow toner image) on the photosensitive drum 2 is transferred (primary transfer) onto the intermediary transfer belt 7 by applying a voltage (primary transfer bias) which is opposite in polarity to the polarity of the toner charge, to a primary transfer roller 8, which is disposed inside the loop which the intermediary transfer belt 7 forms. The primary transfer residual toner on the photosensitive drum 2, that is, the toner which was not transferred onto the intermediary transfer belt 7 and remained on the photosensitive drum 2, is removed from the photosensitive drum 2 by the cleaning means 6.

As soon as the transfer (primary transfer) of the yellow toner image onto the intermediary transfer belt 7 is completed through the above described steps, the step for forming an electrostatic latent image, step for developing the electrostatic latent image, and step of transferring (primary transfer) of the developed latent image, are sequentially repeated for the magenta, cyan, and black components as they were carried out for the yellow component. As a result, yellow, magenta, cyan, and black toner images are placed in layers on the intermediary transfer belt 7, synthetically yielding thereby a single full-color image.

Figure 5:
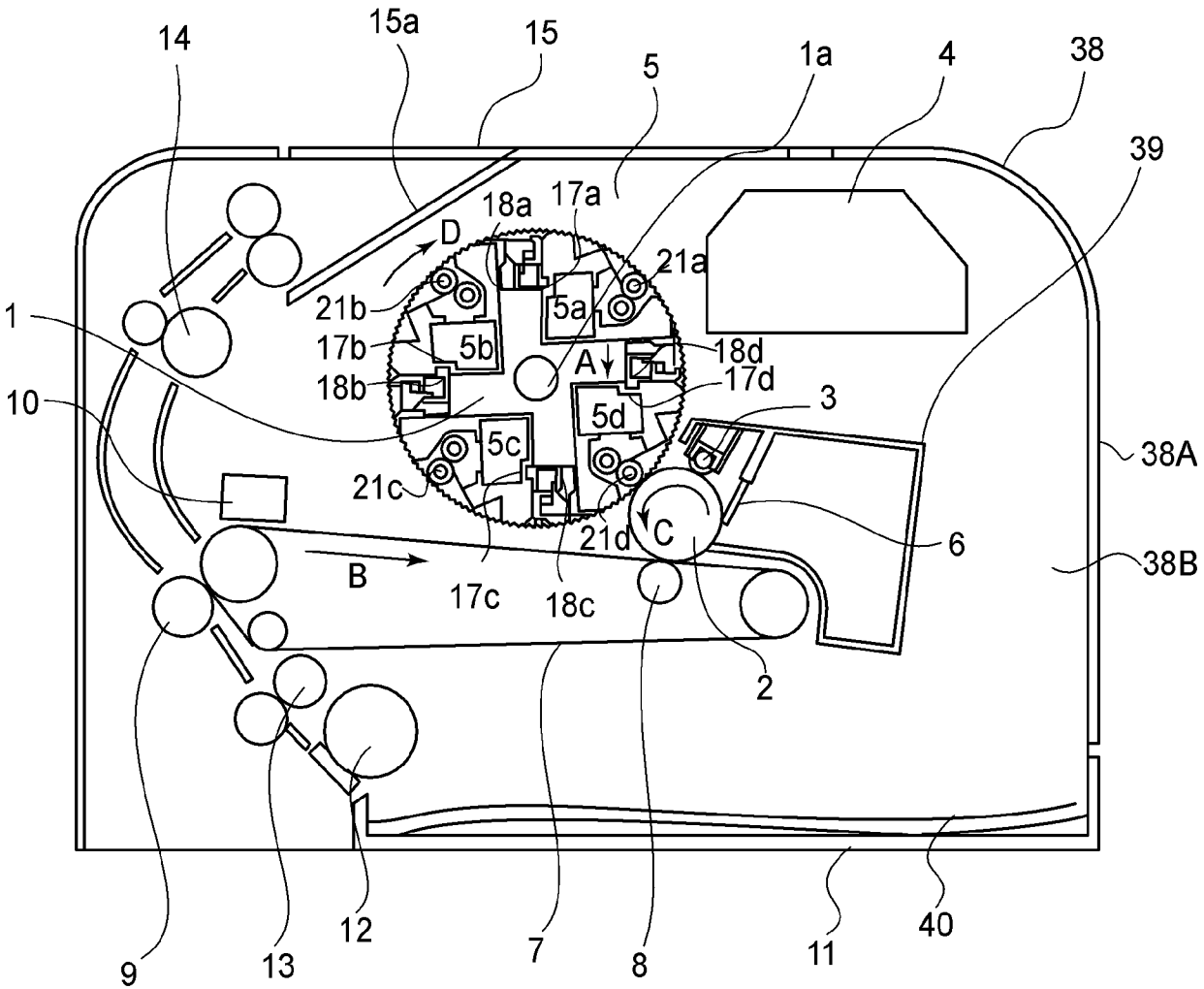
FIG. 5 is a schematic cross-sectional view of the image forming apparatus in the first preferred embodiment of the present invention.

When a magenta toner image is formed on the photosensitive drum 2, the rotary 1 is rotated by a preset angle so that the magenta development cartridge 5*b* is moved into the development position, in which it opposes the photosensitive drum 2 in a preset manner, and is precisely positioned relative to the photosensitive drum 2. That is, the rotary 1 is rotationally driven so that the development roller 21*b* of the magenta development cartridge 5*b* opposes the photosensitive drum 2 in a preset manner. When a cyan toner image is formed on the photosensitive drum 2, the rotary 1 is rotated by a preset angle so that the cyan development cartridge 5*c* is moved into the development position, in which it opposes the photosensitive drum 2 in a preset manner, and is precisely positioned relative to the photosensitive drum 2. That is, the rotary 1 is rotationally driven so that the development roller 21*c* of the cyan development cartridge 5*c* opposes the photosensitive drum 2 in a preset manner. When a black toner image is formed on the photosensitive drum 2, the rotary 1 is rotated by a preset angle so that the black development cartridge 5*d* is moved into the development position, in which it opposes the photosensitive drum 2 in a preset manner, and is precisely positioned relative to the photosensitive drum 2. That is, the rotary 1 is rotationally driven so that the development roller 21*d* of the black development cartridge 5*d* opposes the photosensitive drum 2 in a preset manner. FIG. 5 shows the image forming apparatus in which the black development cartridge 5*d* was moved into the development position in which it opposes the photosensitive drum 2 in a preset manner, and has just been precisely positioned in the developing position.

While the yellow, magenta, cyan, and black toner images are formed through the above described sequential steps, that is, the electrostatic latent image formation step, development step, and primary transfer step, a secondary transfer roller 9 is kept separated from the intermediary transfer belt 7 as shown in FIGS. 4A and 4B, and so is a cleaning unit 10 for cleaning the intermediary transfer belt 7.

As for the sheet (recording medium) 40, onto which the toner images are to be transferred, multiple sheets 40 are stored in layers in a sheet feeder cassette 11, which is located in the bottom portion of the main assembly 38*a* of the image forming apparatus 38. The multiple sheets 40 are fed out from the sheet feeder cassette 11 by a sheet feeder roller 12 while being separated one by one from the rest, and then, each is conveyed to a pair of registration rollers 13.

The secondary transfer roller 9 is moved to the intermediary transfer belt 7 so that it is pressed upon the intermediary transfer belt 7 at the same time as the leading edges of the four layers monochromatic toner images, different in color, which have just been transferred onto the intermediary transfer belt 7, reach a position which is a preset distance from the preset point of contact between the secondary transfer roller 9 and intermediary transfer belt 7. FIG. 5 shows the image forming apparatus 38 when the secondary transfer roller 9 is remaining pressed upon the intermediary transfer belt 7. The interface created by the pressing of the secondary transfer roller 9 upon the intermediary transfer belt 7 is the secondary transfer portion. Further, the cleaning unit 10 for cleaning the intermediary transfer belt 7 is also placed in contact with the intermediary transfer belt 7.

As the fed sheet 40 is delivered to the registration rollers 13, the registration rollers 13 send the delivered sheet 40 to the secondary transfer portion, that is, the compression nip between the intermediary transfer belt 7 and secondary transfer roller 9, with preset control timing. Then, a preset voltage (secondary transfer bias), which is opposite in polarity to the toner charge, is applied to the secondary transfer roller 9 with a reset control timing. Thus, while the sheet 40 is conveyed through the secondary transfer portion, remaining sandwiched by the intermediary transfer belt 7 and secondary transfer roller 9, the four layers of monochromatic toner images, different in color, on the intermediary transfer belt 7 are transferred (secondary transfer) all together onto the surface of the sheet 40.

After the transfer (secondary transfer) of the toner images onto the sheet 40, the sheet 40 is separated from the intermediary transfer belt 7, and is sent to a fixing device 14. In the fixing device 14, the sheet 40 is subjected to heat and pressure, whereby the toner images are melted and permanently fixed to the sheet 40 while being mixed. As a result, a single full-color image is effected on the sheet 40. Thereafter, the sheet 40 is discharged from the fixing device 14 into a delivery portion, which is an integral part of the top cover 15 of the image forming apparatus.

The secondary transfer residual toner, that is, the portion of the four layers of toner images, which did not transferred onto the sheet 40 from the intermediary transfer belt 7, is removed from the intermediary transfer belt 7 by the cleaning unit 10.

As soon as the trailing edge of the sheet 40 passes the secondary transfer portion, the secondary transfer roller 9 is separated from the intermediary transfer belt 7. As soon as the residual toner is completely removed, the cleaning unit 10 is separated from the photosensitive drum 2.

(Description of Development Cartridge)

The yellow development cartridge 5*a*, magenta development cartridge 5*b*, cyan development cartridge 5*c*, and black development cartridge 5*d* in this embodiment are the same in structure. Thus, only the structure of the yellow development cartridge 5*a* will be described as the structure that represents the structure for all the development cartridges.

Figure 3B:
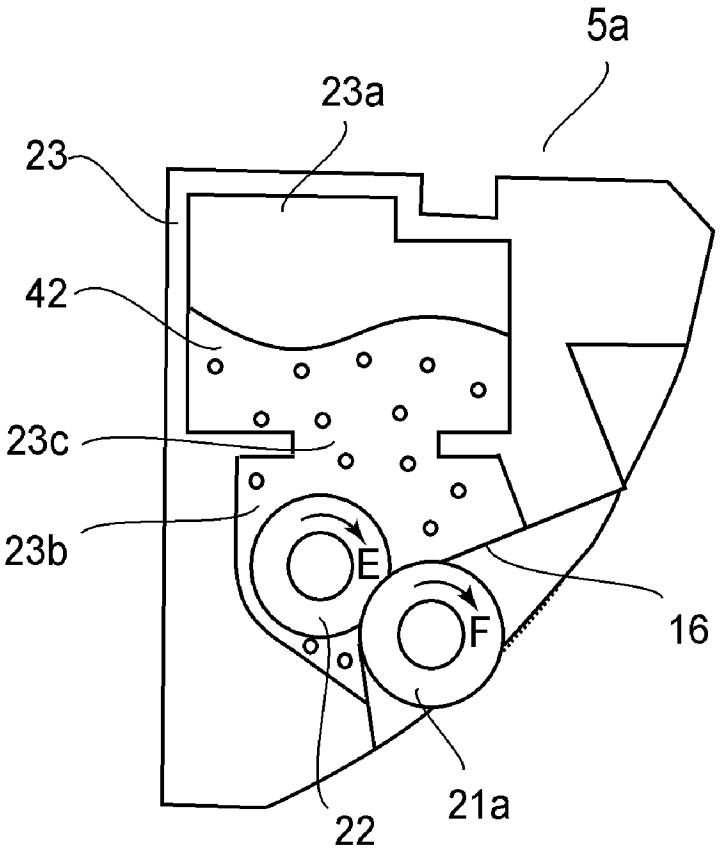
FIG. 3B is a schematic cross-sectional view of the development cartridge in the first preferred embodiment of the present invention, the toner seal of which has been removed.

The yellow development cartridge 5*a* will be described with reference to FIGS. 3A and 3B, which are cross-sectional views of the yellow development cartridge 5*a* in this embodiment. The developing means container 23 of the yellow development cartridge 5*a* is made up of a toner storage chamber 23*a*, and a developing means chamber 23*b* which contains the development roller 21*a* and a toner supply roller 22. Roughly speaking, the toner storage chamber 23*a* and developing means chamber 23*b* make up the top and bottom halves, respectively, of the developing means container 23, and are in connection to each other through a toner supply passage 23*c*.

Figure 3A:
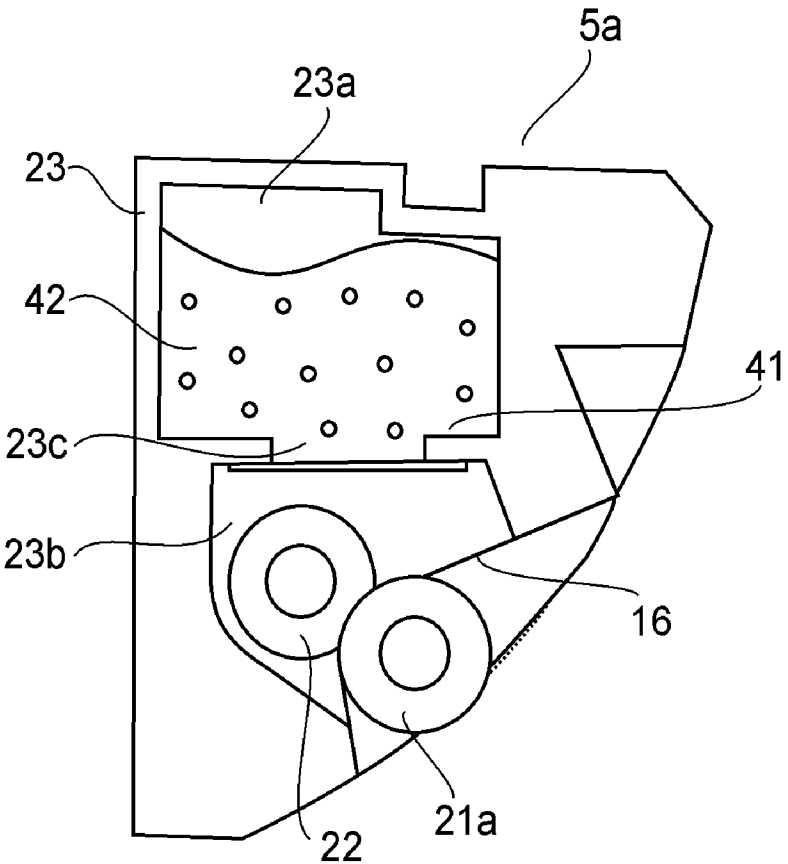
FIG. 3A is a schematic cross-sectional view of the development cartridge in the first preferred embodiment of the present invention, the toner seal of which has not been removed.

FIG. 3A shows the yellow development cartridge 5*a* before the arrival of the cartridge 5*a* at a user, that is, before the cartridge 5*a* is used for the first time. Until the cartridge 5*a* is used for the first time, the toner supply passage 23*c* remains blocked by a toner seal 41 (piece of film), which was thermally fixed to the developing means container 23 to keep the toner storage chamber 23*a* separated from the developing means chamber 23*b*.

The toner seal 41 is to be removed before the yellow development cartridge 5*a* is put to use for the first time. The removal of the toner seal 41 allows the toner in the toner storage chamber 23*a* to naturally falls into the development chamber 23*b*, as shown in FIG. 3B, as the yellow development cartridge 5*a* is moved into the development position in which it opposes the photosensitive drum 2 as shown in FIG. 4B. In other words, the toner 42 in the development chamber 23*b* is supplied to the toner supply roller 22, which supplies the development roller 21*a* with the toner 42 by rotating in the direction indicated by an arrow mark E in FIG. 3B. The development roller 21*a* is in the form of an elastic rubber roller, and is rotated in the direction indicated by an arrow mark F in FIG. 3B. The body of toner 42 on the development roller 21*a* is regulated in thickness by a development blade 16, and is adhered to the photosensitive drum 2 to develop the latent image on the photosensitive drum 2. The toner 42 remaining on the development roller 21*a* after the development is removed by the toner supply roller 22. Then, the development roller 21*a* is supplied again with a fresh supply of toner 42 by the toner supply roller 22.

In the development position, in order to ensure that the development roller 21*a* remains in contact with the photosensitive drum 2, the rotary 1, which is holding the yellow development cartridge 5*a*, is kept pressured toward the photosensitive drum 2. In other words, a preset amount of contact pressure is maintained between the development roller 21*a* of the yellow development cartridge 5*a*, and the photosensitive drum 2, by keeping the rotary 1 pressured toward the photosensitive drum 2.

(Description of Drum Cartridge 39)

Figure 2:
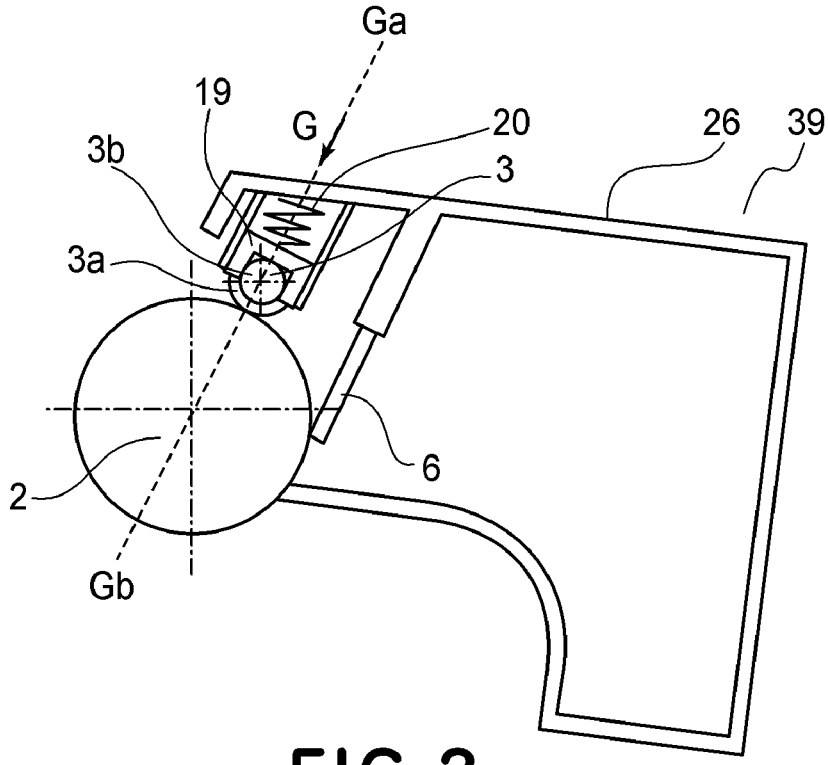
FIG. 2 is a schematic cross-sectional view of the drum cartridge, in the first preferred embodiment of the present invention, the covering member and separating member of which have been removed.

Next, referring to FIGS. 2, 4A, 4B, 5, and 9, the drum cartridge 39 will be described. FIG. 2 is a cross-sectional view of the drum cartridge 39 in this embodiment. Referring to FIGS. 4A, 4B, and 5, the main assembly 38*a* of the image forming apparatus 38 is structured so that as the drum cartridge 39 is mounted into the main assembly 38*a*, it is precisely positioned, and remains precisely positioned, relative to the main assembly 38*a*. Referring to FIG. 2, the drum cartridge 39 is an integration of the photosensitive drum 2, charging means 3, and cleaning means 6. The charging means 3 is a means for uniformly charging the photosensitive drum 2 before the formation of a latent image. The cleaning means 6 is a means which removes the transfer residual toner (developer) on the photosensitive drum 2, and stores the removed transfer residual toner in the cleaning means container 26. The cleaning means 6 in this embodiment employs a cleaning blade.

Figure 9:
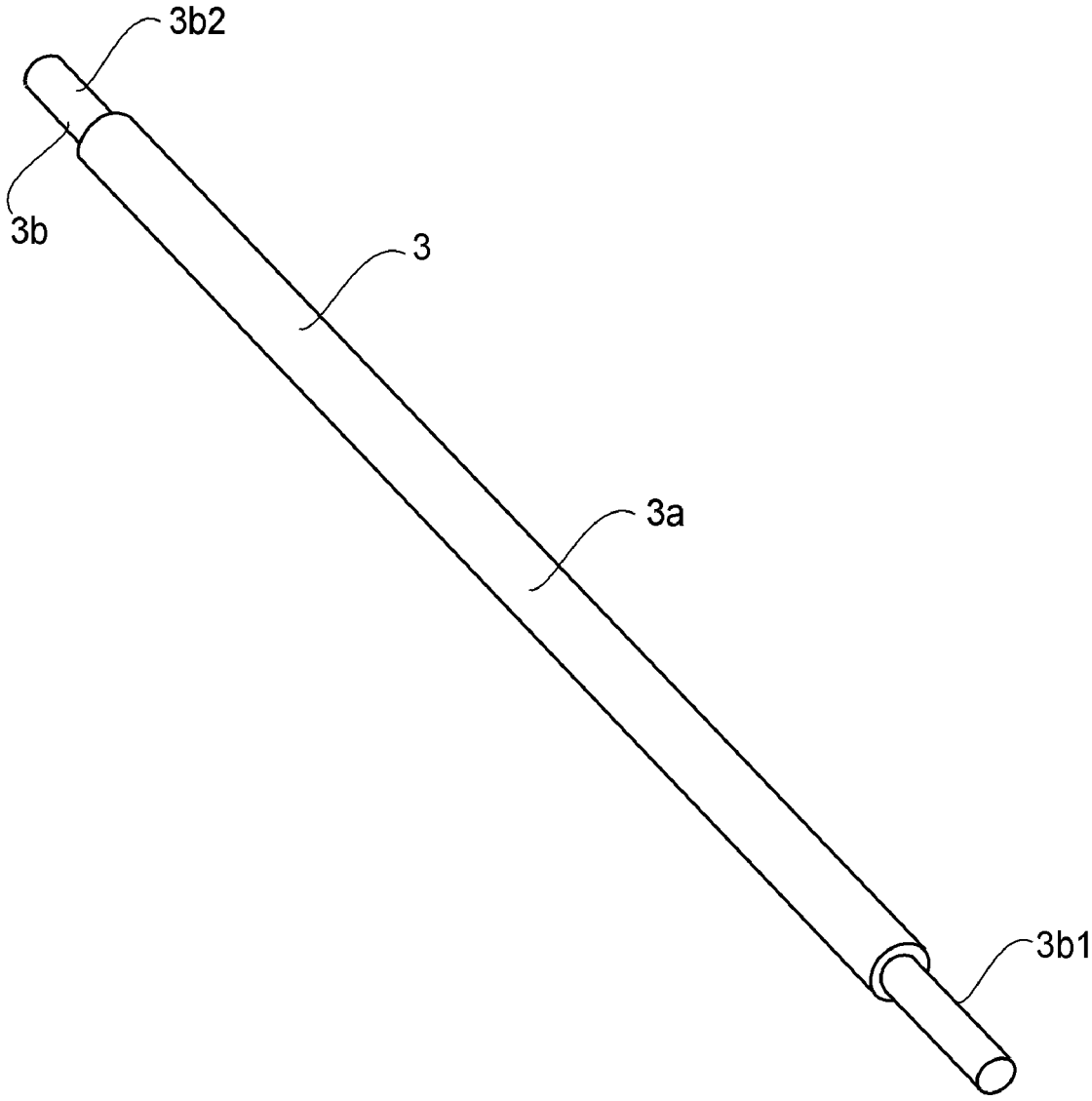
FIG. 9 is a perspective view of the charge roller.

At this time, the structure of the charging means 3 will be described. In this embodiment, the charging means 3 employs a charge roller. Hereafter, therefore, the charging means 3 will be described as a charge roller 3. Referring to FIG. 9, the charge roller 3 is made up of a rubber roller 3*a* (roller made of rubber) and a rigid shaft 3*b*. The rigid shaft 3*b* is put through the rubber roller 3*a*, from one lengthwise end of the rubber roller 3*a* to the other, in such a manner that its axial line coincides with that of the rubber roller 3*a*. The lengthwise ends 3*b*1 and 3*b*2 of the rigid shaft 3*b* extend from the lengthwise ends of the rubber roller 3*a*, respectively, by a preset length.

Each charge roller bearing 19 is movably held to the cleaning means container 26 in such a manner that its center remains coincidental with the line Ga-Gb, which coincides with the center of the charge roller 3 and the center of the photosensitive drum 2. Referring to FIG. 2, one of the lengthwise ends of the charge roller 3 is rotationally held by one of the charge roller bearing 19; the lengthwise end 3*b*1 of the rigid shaft 3*b* is rotatably held by one of the charge roller bearing 19, and the other lengthwise end 3*b*2 of the rigid shaft 3*b* is held by the other charge roller bearing 19. The charge roller 3 is kept pressured in the direction indicated by an arrow mark G, that is, toward the photosensitive drum 2.

(Covering Member 24 and Separating Member 25)

Figure 1:
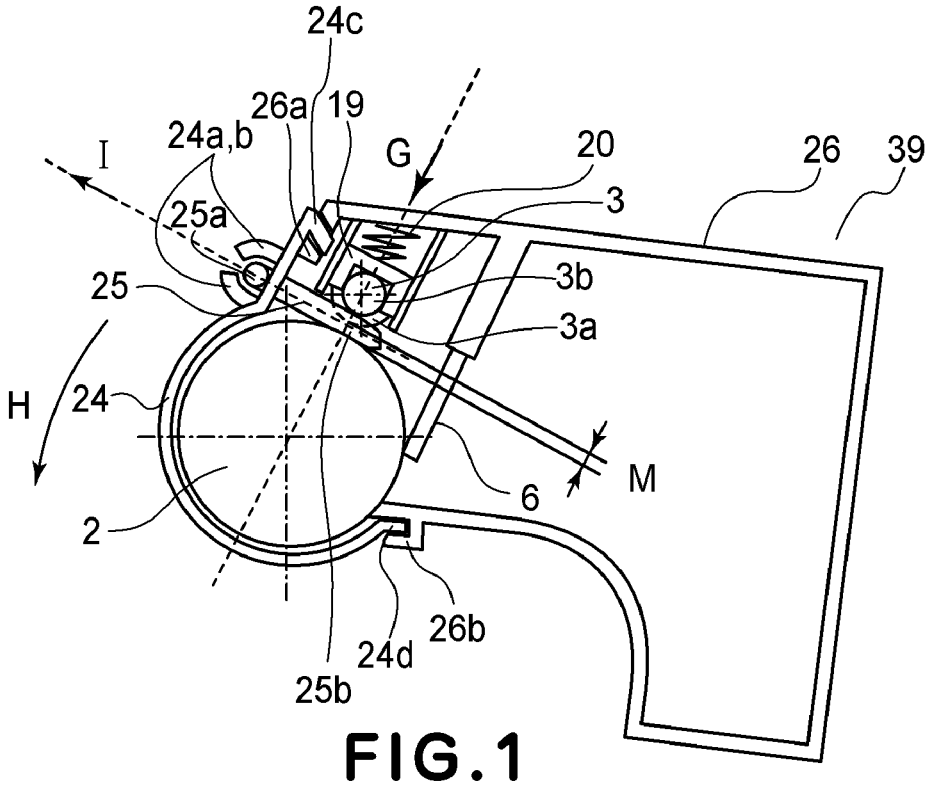
FIG. 1 is a schematic cross-sectional view of the drum cartridge, in the first preferred embodiment of the present invention, the covering member and separating member of which have not been removed.

Next, referring to FIGS. 1, 6, and 7, the covering member 24 for protecting the photosensitive drum 2, and the separating member 25 to keep the charge roller 2 separated from the photosensitive drum 2, will be described. FIG. 1 is a cross-sectional view of the drum cartridge 39, in this embodiment, fitted with the covering member 24 for protecting the photosensitive drum, and the separating member 25.

In order to develop an electrostatic latent image formed on the peripheral surface of the photosensitive drum 2, and to transfer the toner image developed on the peripheral surface of the photosensitive drum 2, the peripheral surface of the photosensitive drum 2 in the above described drum cartridge 39 has to be widely exposed. However, the operation for exchanging the drum cartridge 39 in this embodiment is to done by a user him- or her-self. Thus, it is possible that the photosensitive drum 2 will be damaged between when the drum cartridge 39 is shipped out from a factor, warehouse, or the like, and when the drum cartridge 39 is mounted into the image forming apparatus 38. Therefore, in order to keep the photosensitive drum 2 protected while the development cartridge 39 remains unused, more specifically, before the development cartridge 39 reaches a user, in particular, while the development cartridge 39 is commercially distributed, it is necessary that the removable covering member 24 is attached to the drum cartridge.

The covering member 24 is a member which is removably attached to the drum cartridge 39 to cover the peripheral surface of the photosensitive drum 2. More specifically, the covering member 24 is provided with first and second anchoring portions 24*c* and 24*d*, whereas the cleaning means container 26, which is a part of the drum cartridge frame, is provided with a covering member retaining portions 26*a* and 26*b*. Thus, the covering member 24 is attached to the drum cartridge 39 by engaging the first and second anchoring portions 24*c* and 24*d* of the covering member 24 into the covering member retaining portions 24*c* and 24*d*, respectively, of the drum cartridge 39. The covering member anchoring portions 26*a* and 26*b* of the drum cartridge 39 may be formed as parts of the drum cartridge 39 other portion than the cleaning means container 26.

The method for removing the covering member 24 from the drum cartridge 39 is as follows: First, the anchoring portion 24*c*, which is in engagement with the covering member retaining portion 26*a*, is to be disengaged from the covering member retaining portion 26*a*, and then, the covering member 24 is to be rotated about the anchoring portion 24*d*, so that the covering member 24 can be removed from the drum cartridge 39 in the direction indicated by an arrow mark H in FIG. 1.

The charge roller 3 is kept pressured toward the photosensitive drum 2 by a pair of charge roller pressing members 20. Thus, it is possible that the rubber roller 3*a* will be deformed by the time the drum cartridge 39 is delivered to a user. Therefore, in order to prevent the charge roller 3 from being deformed before the drum cartridge 39 reaches a user, more specifically, before the development cartridge 39 is used for the first time, it is necessary for the charge roller 3 to be kept separated from the photosensitive drum 2 until the development cartridge 39 is used for the first time.

Referring to FIG. 1, in this embodiment, the separating member 25 is placed between the aforementioned rigid shaft 3*b* of the charge roller 3, and the peripheral surface of the photosensitive drum 2, in order to maintain a distance M between the peripheral surface of the photosensitive drum 2 and rubber roller 3*a*. That is, the separating member 25 is inserted between the peripheral surface of the photosensitive drum 2, and the rigid shaft 3*b* of the charge roller 3, to keep the charge roller 3 separated from the peripheral surface of the photosensitive drum 2. In this embodiment, two separating members 25 are employed, which are placed at the lengthwise ends of the covering member 24 one for one. More concretely, one of the separating members 25 is placed between the lengthwise end portion 3*b*1 (FIG. 9) of the rigid shaft 3*b*, and the photosensitive drum 2, and the other separating member 25 is placed between the lengthwise end portion 3*b*2 (FIG. 9), and the photosensitive drum 2. However, the development cartridge 39 may be structured to employ only one separating member 25, which is inserted between the photosensitive drum 2, and either lengthwise end portion 3*b*1 or 3*b*2 of the charging roller 3. Further, in terms of the direction parallel to the axial line of the photosensitive drum 2, the separating member 25 is placed on the outward side of the cleaning means 6 of the drum cartridge 39. Further, the in terms of the direction perpendicular to the axial line of the photosensitive drum 2, the separating member 25 is between the first and second anchoring portions 24*c* and 24*d*.

Figure 6B:
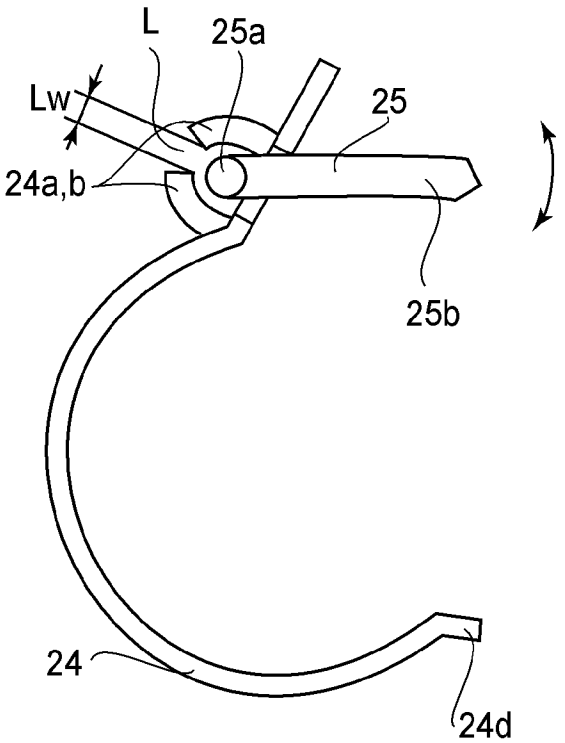
FIGS. 6A and 6B are cross-views of the covering member and separating member, which are for describing the structural arrangement for keeping connected the covering member and separating member in the first preferred embodiment.
Figure 6A:
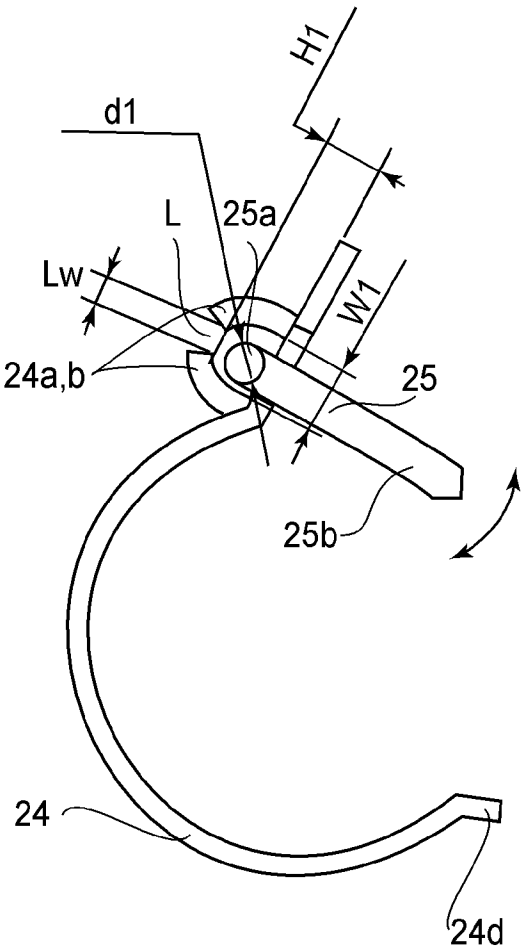
Figure 7:
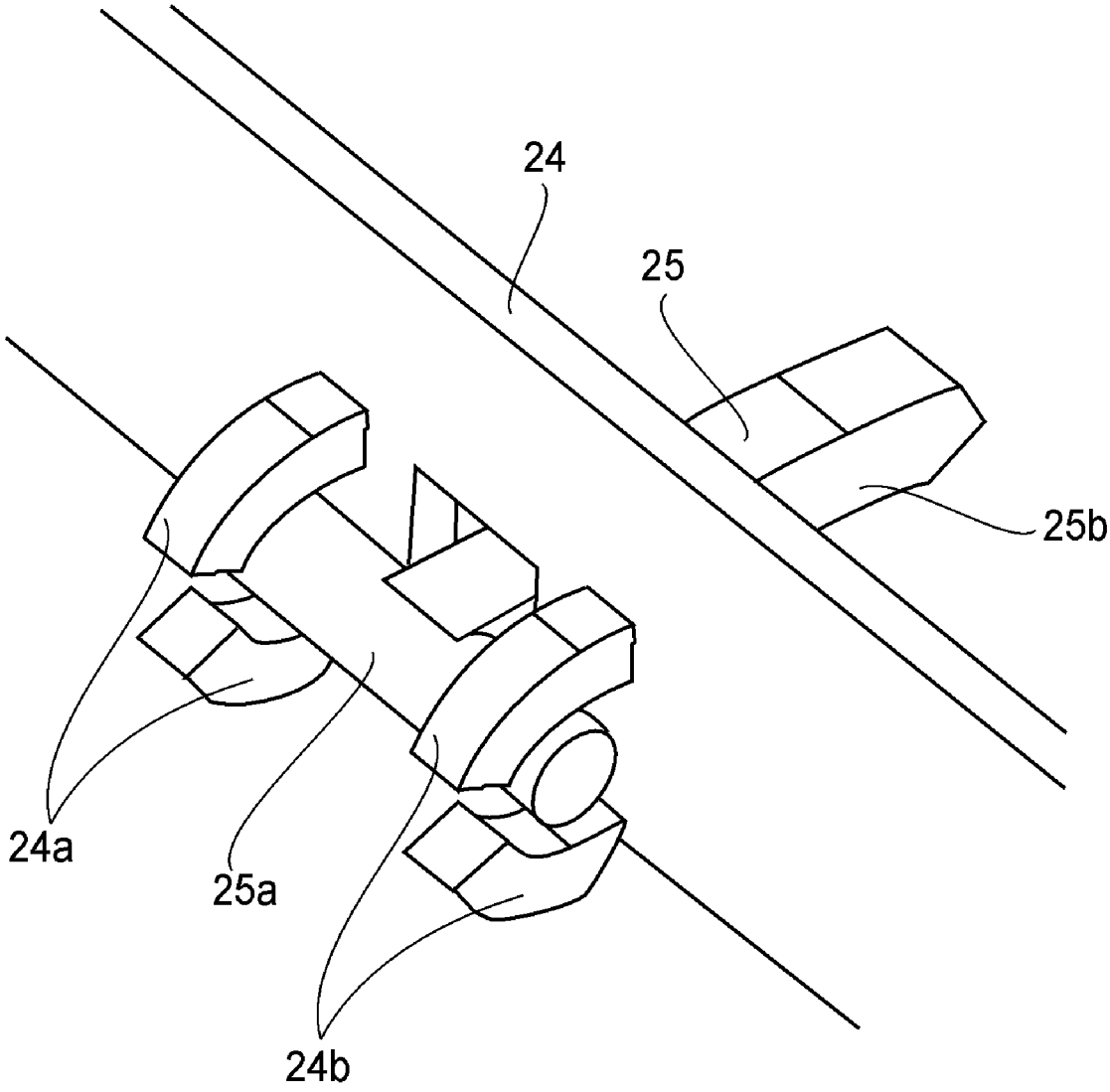
FIG. 7 is a perspective view of the joint between the covering member and separating member.

Referring to FIGS. 6 and 7, the separating member 25 has a cylindrical shaft 25*a* and a separating portion 25*b*. As the shaft 25*a* of the separating member 25 is engaged with the separating member retaining portions 24*a* and 24*b* of the covering member 24, the separating member 25 is movably supported by the covering member 24. Further, the arcuate portion of the retaining portion 24*a*, and the arcuate portion of the retaining portion 24*b*, are provided with a slit L. Referring to FIG. 6, the slit width Lw is slightly narrower than the diameter d of the shaft 25*a*. Normally, therefore, the separating member 25 does not disengage from the covering member 24, although it can be disengaged from the covering member 24. That is, the separating member 25 is removable from the covering member 24, and is held to the covering member 24 so that it is movable relative to the covering member 24. Further, the height H1 of the inward side of each of the retaining portions 24*a* and 24*b*, and the width W1 between the two portions of each of the retaining portions 24*a* and 24*b*, are made greater than the diameter d1 of the shaft 25*a*, because of the following reason (which will be described later in more detail): Affording the separating member 25 and covering member 24 more latitude in their movement relative to each other can reduce the amount of force necessary to remove the covering member 24 and prevent the photosensitive drum 2, etc., from being damaged during the removal of the covering member 24.

(Removal of Covering member 24 and Separating Member 25)

Next, referring to FIGS. 1, and 5-8, the removal of the covering member 24 and separating member 25 will be described.

Basically, the direction in which the separating member 25 is to be moved to remove the separating member 25 is desired to be perpendicular to the line which connects the center of the photosensitive drum 2 and the center of the charge roller 3. That is, it is desired to be the direction indicated by an arrow mark I in FIG. 1. In order to allow the separating member 25 to be removed in the direction indicated by the arrow mark I, it is necessary that the covering member 24 also can be removed in the direction I.

Referring to FIGS. 1, 6, and 7, in this embodiment, therefore, the separating member 25 is supported by the covering member 24 in such a manner that the separating member 25 is enabled to move relative to the covering member 24. Next, referring to FIGS. 8A-8D, as a user moves the covering member 24 in the direction indicated by the arrow mark H in FIGS. 8A-8C, the separating member 25 moves relative to the covering member 24.

Figure 8B:
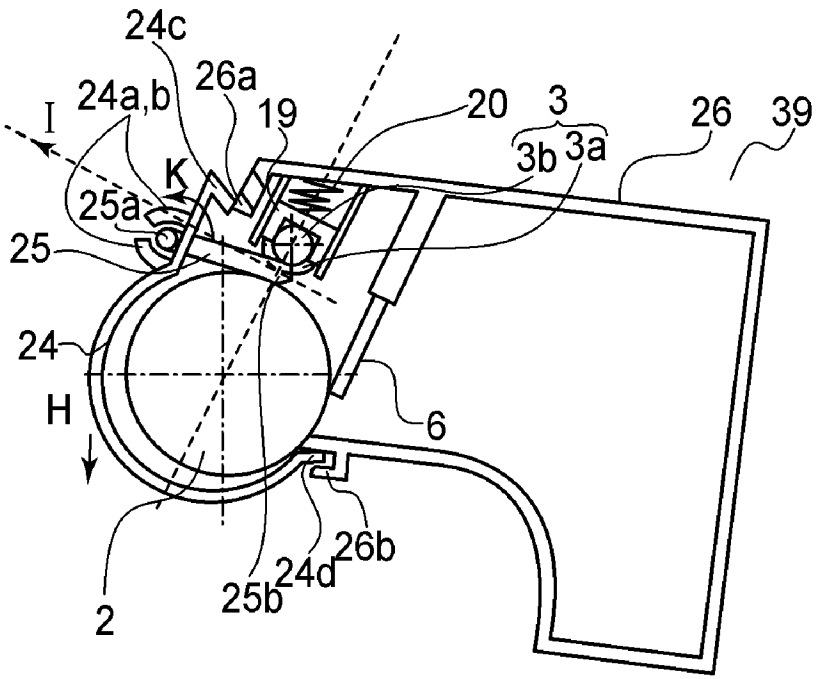
FIGS. 8A-8D are drawings for describing the steps for disengaging the covering member and separating member from the cartridge.
Figure 8A:
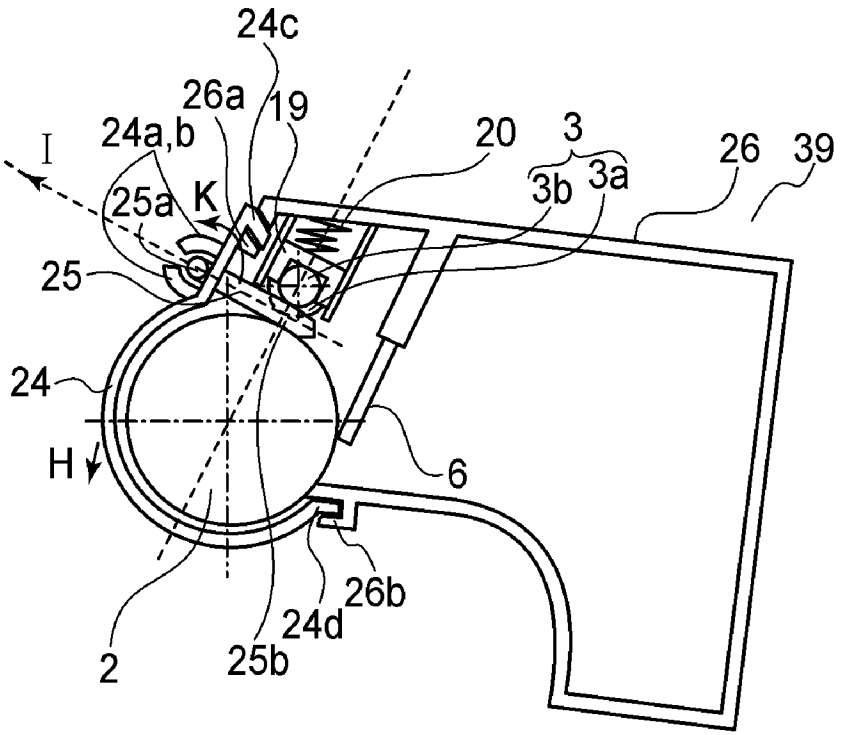

Referring to FIGS. 8A and 8B, in the initial stage of the operation for removing the covering member 24 from the cleaning means container 26, the separating member 25 rotationally moves relative to the covering member 24 in the direction indicated by an arrow mark K while remaining pinched between the photosensitive drum 2, and the rigid shaft 3*b* of the charge roller 3 (charging means). Here, the direction K in which the separating member 25 rotationally moves is opposite to the direction H in which the covering member 24 is to be rotationally moved in order to remove the covering member 24 from the cleaning means container 26. The employment of this structural arrangement can significantly reduce the amount of force necessary to remove the covering member 24 equipped with the separating member 25, and also, can prevent the photosensitive drum 2 and charge roller 3 from being damaged when the covering member 24 is removed.

In a case of the structural arrangement which solidly attaches the separating member 25 to the covering member 24, when the covering member 24 is removed from the cleaning means container 26, as the covering member 24 is rotationally moved in the direction H, the separating member 25 is moved in the direction to push upward the charge roller 3. As the charge roller 3 is pushed upward, the charge roller pressing member 20 is more compressed than it is in FIG. 8A. Thus, the amount of force necessary to remove the covering member 24 is increased. Moreover, the separating member 25 is pressed upon the photosensitive drum 2, and the rigid shaft 3*b* of the charge roller 3, by the greater amount of force, making it possible for the photosensitive drum 2 and charge roller 3 to be damaged.

Figure 8D:
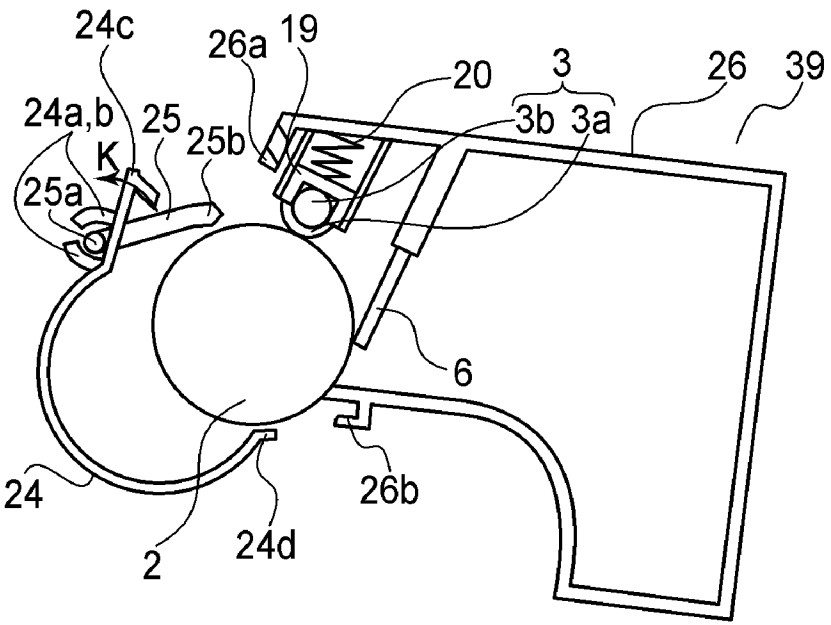
Figure 8C:
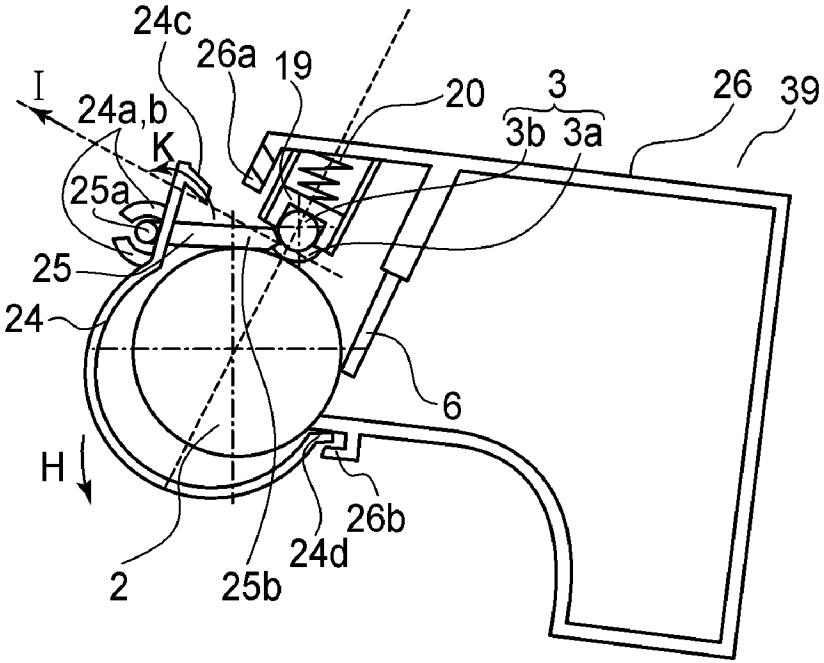

Referring to FIGS. 8C and 8D, in this embodiment, as the covering member 24 is rotationally moved in the direction H, the separating member 25 is moved from between the photosensitive drum 2, and the rigid shaft 3*b* of the charge roller 3, whereby the charge roller 3, which was kept separated from the photosensitive drum 2, is placed in contact with the photosensitive drum 2. Further, the drum cartridge 39 is structured so that even when the drum cartridge 39 is in the state shown in FIGS. 8C and 8D, the separating member 25 is rotatable relative to the covering member 24. Therefore, it does not occur that the separating member 25 is pressed harder on the photosensitive drum 2 than it has been. Therefore, it does not occur that the separating member 25 damages the photosensitive drum 2 and/or charge roller 3.

Next, referring to FIG. 6, the height H1 and width W1 of the inward side of each of the retaining portions 24*a* and 24*b* was made larger than the diameter d1 of the shaft 25*a*, by an amount large enough to provide a substantial amount of play. This structural arrangement makes it possible to allow the separating member 25 to move relative to the covering member 24 in the radius direction of the shaft 25*a*. Therefore, it can reduce the amount of force necessary to remove the covering member 24, and also, can prevent the photosensitive drum 2, etc., from being damaged when the covering member 24 is removed.

Further, the amount, by which the contact pressure between the separating member 25 and photosensitive drum 2 increases when the covering member 24 is removed, can be reduced by giving the portion of the surface of the separating portion 25*b*, which contacts the peripheral surface of the photosensitive drum 2, a curvature which matches the curvature of the peripheral surface of the photosensitive drum 2, and the reduction in this amount can prevent the separating member 25 and/or photosensitive drum 2 from being damaged when the covering member 24 is removed.

[Embodiment 2]

Figure 10:
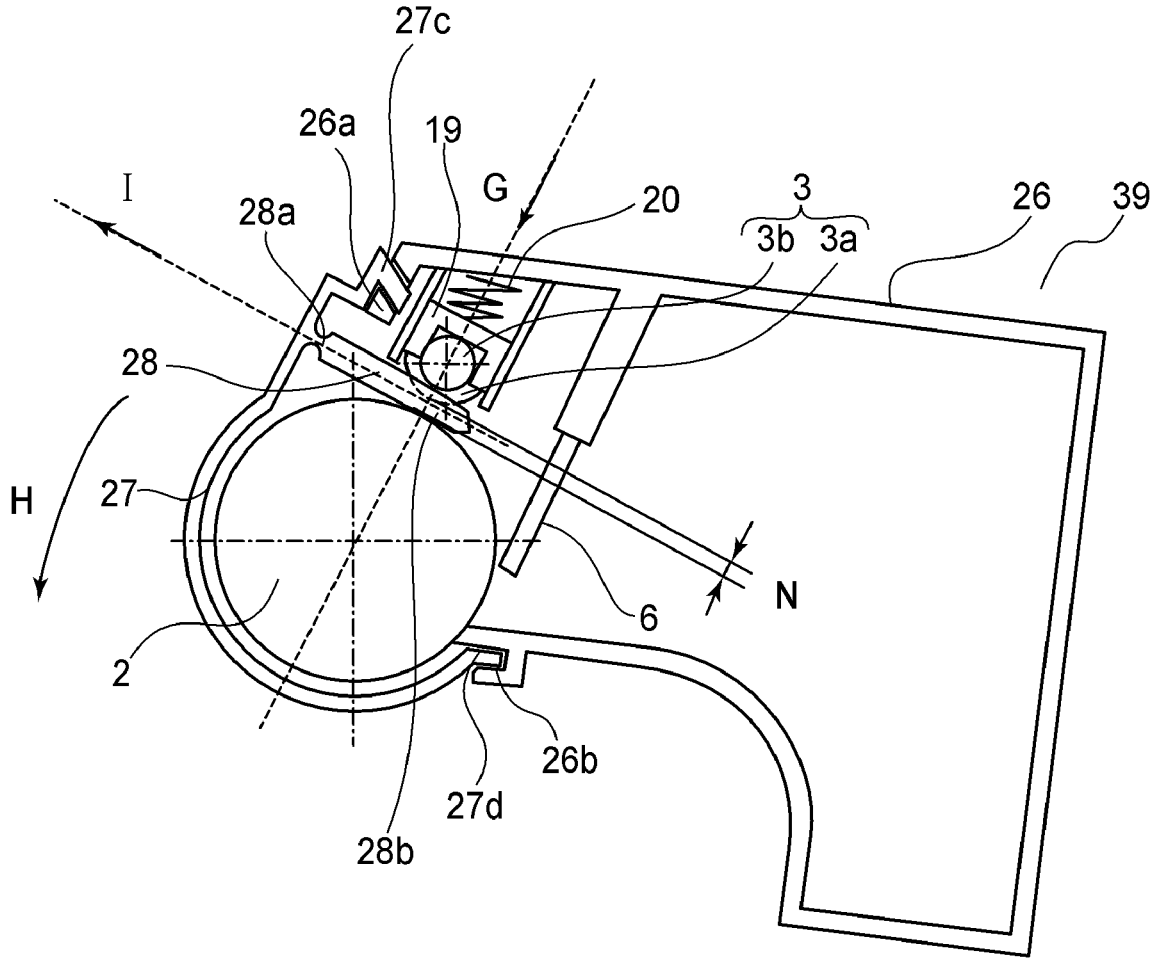
FIG. 10 is a schematic cross-sectional view of the drum cartridge, in the second preferred embodiment of the present invention, the covering member and separating member of which have not been removed.

Next, the embodiment of the present invention, in which the separating member is a part of the covering member, or vice versa, will be described. FIG. 10 is a cross-sectional view of the drum cartridge and its covering member in this embodiment. The members, portions, etc., in this embodiment, which are the same in description as the counterparts in the first preferred embodiment, will be given the same referential codes, and will not be described.

(Covering Member with Separating Portion)

The covering member 27 is attached to the drum cartridge 39 by engaging its anchoring portions 27*c* and 27*d*, with the covering member retaining portions 26*a* and 26*b*, respectively, with which the cleaning means container 26 is provided. The covering member 27 is for protecting the photosensitive drum 2 until the drum cartridge 39 reaches a user, in particular, during the commercial distribution of the drum cartridge 39, more specifically, until the drum cartridge 29 is used for the first time. The covering member retaining portions 26*a* and 26*b* of the drum cartridge 39, by which the covering member 27 is retained by the drum cartridge 39 may be formed as parts of the drum cartridge 39 other than the cleaning means container 26.

The method for removing the covering member 27 from the drum cartridge 39 is as follows: First, the anchoring portion 27*c*, which is in engagement with the covering member retaining portion 26*a*, is to be disengaged from the covering member retaining portion 26*a*, and then, the covering member 27 is to be rotated about the anchoring portion 27*d*, so that the covering member 27 can be removed from the drum cartridge 39 in the direction indicated by an arrow mark H.

In this embodiment, the covering member 27 has a pair of separation arms 28, which are placed in contact with the development cartridge 39 in such a manner that the separation arms 28 are placed between the lengthwise end portions 3*b*1 and 3*b*2 (FIG. 9) of the rigid shaft 3*b* of the charge roller 3, and the peripheral surface of the photosensitive drum 2, in order to maintain a distance (gap) N between the peripheral surface of the photosensitive drum 2 and the peripheral surface of the rubber roller 3*a*, as shown in FIG. 10. That is, the separation arms 28 are inserted between the peripheral surface of the photosensitive drum 2, and the rigid shaft 3*b* of the charge roller 3 to keep the charge roller 3 separated from the photosensitive drum 2. The employment of this structural arrangement prevents the charge roller 3 from being deformed until the drum cartridge 39 arrives at a user, more specifically, before the drum cartridge 39 is used for the first time. In this embodiment, two separation arms 28 are employed, which are placed at one of the lengthwise ends of the covering member 27 and the other, in terms of the direction parallel to the axial line of the photosensitive drum 2. That is, one of the separation arms 28 is placed between the lengthwise end portion 3*b*1 of the rigid shaft 3*b* of the charge roller 3, and the photosensitive drum 2, and the other separation arm 28 is placed between the lengthwise end portion 3*b*2, and the photosensitive drum 2. However, the development cartridge 39 may be structured to employ only one separation arm 28, which is inserted between the photosensitive drum 2, and either lengthwise end portion 3*b*1 or 3*b*2 of the charging roller 3. Further, in terms of the direction parallel to the axial line of the photosensitive drum 2, the separation arm 28 is placed on the outward side of the cleaning means 6 of the drum cartridge 39. Further, in terms of the direction perpendicular to the axial line of the photosensitive drum 2, the separation arm 28 is placed between the first and second anchoring portions 24*c* and 24*d*.

Figure 11B:
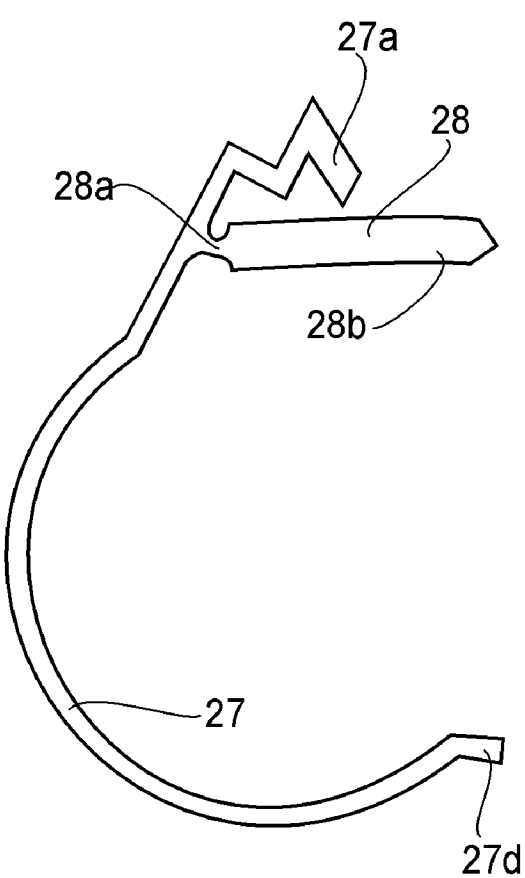
FIGS. 11A and 11B are cross-views of the covering member and separating member, which are for describing the structural arrangement for keeping connected the covering member and separating member in the second preferred embodiment.
Figure 11A:
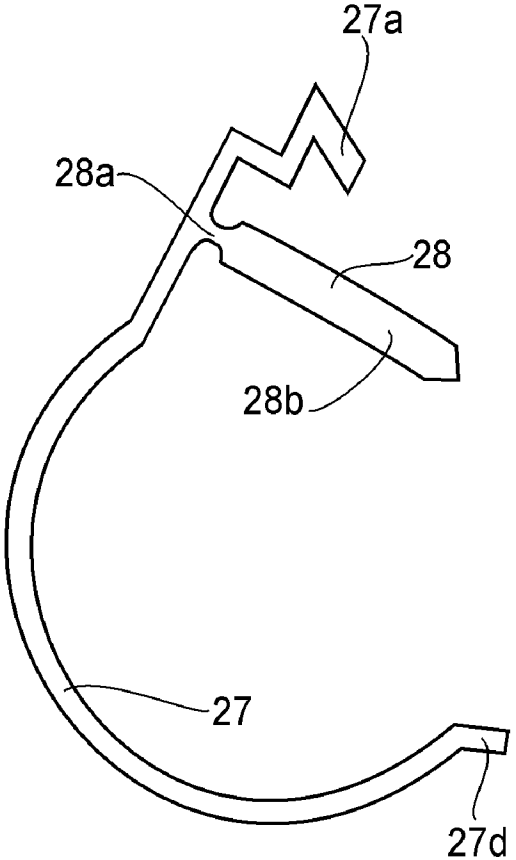

Referring to FIGS. 11A and 11B, the separation arm 28 has at least one or more hinge-like portion 28*a*, and a separating portion 28*b*. The provision of the hinge-like portion 28*a* allows the separating portion 28*b* of the separation arm 28 to move relative to the covering member 27. More concretely, the cover 28 is formed of a resinous substance, such as PP (polypropylene), and the hinge-like portion 28*a* is made thinner than the separating portion 28, being enabled to function like a hinge.

Figure 12B:
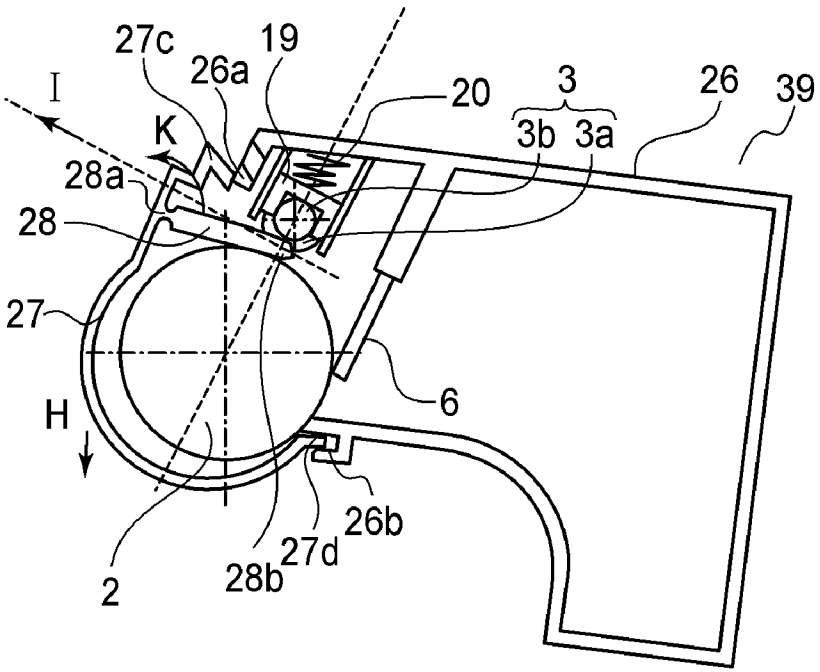
FIGS. 12A-12D are drawings for describing the steps for disengaging the covering member and separating member from the cartridge, in the second preferred embodiment.
Figure 12A:
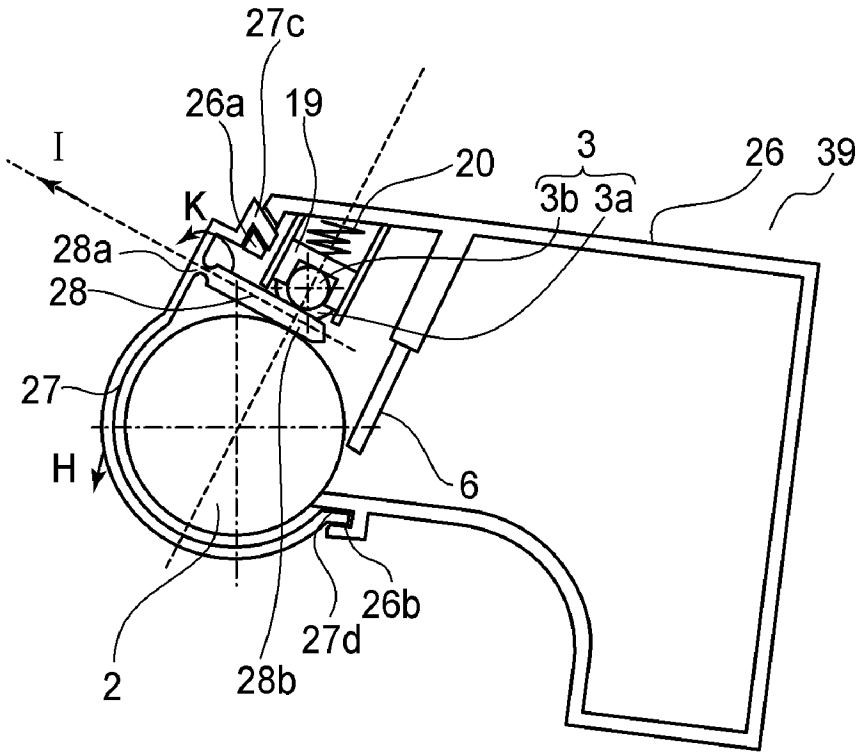

Referring to FIGS. 12A and 12B, in the initial stage of the operation for removing the covering member 27 from the cleaning means container 26, separating portion 28*b* of the separation arm 28 rotationally moves relative to the covering member 27 in the direction indicated by an arrow mark K while remaining pinched between the photosensitive drum 2, and the rigid shaft 3*b* of the charge roller 3 (charging means). Here, the direction K in which the separating portion 28*b* of the separation arm 28 rotationally moves is opposite to the direction H in which the covering member 27 is to be rotationally moved in order to remove the covering member 27 from the cleaning means container 26. The employment of this structural arrangement can significantly reduce the amount of force necessary to remove the covering member 27 equipped with the separation arms 28, and also, prevent the photosensitive drum 2 and charge roller 3 from being damaged when the covering member 27 is removed.

Figure 12D:
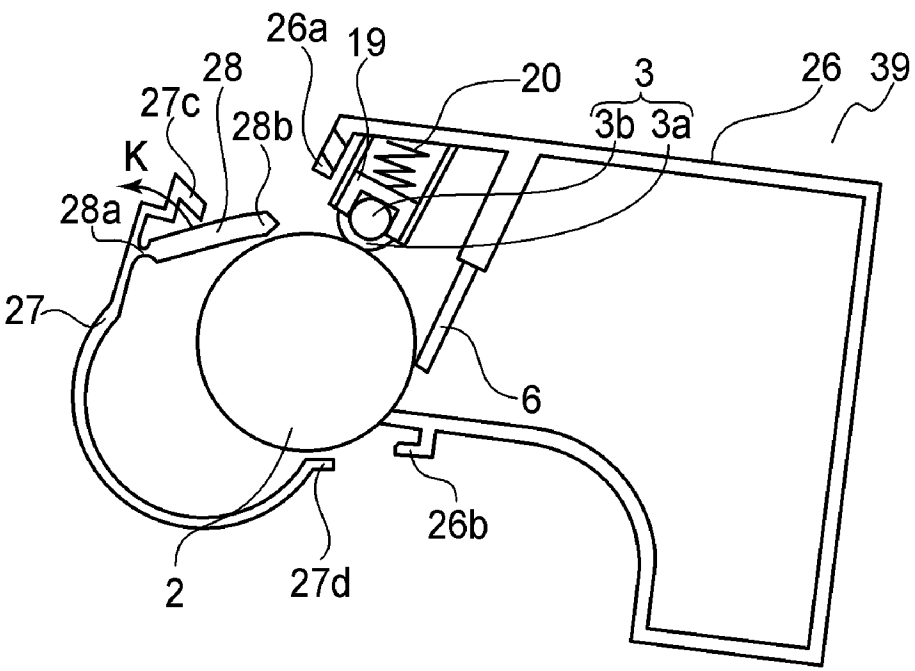
Figure 12C:
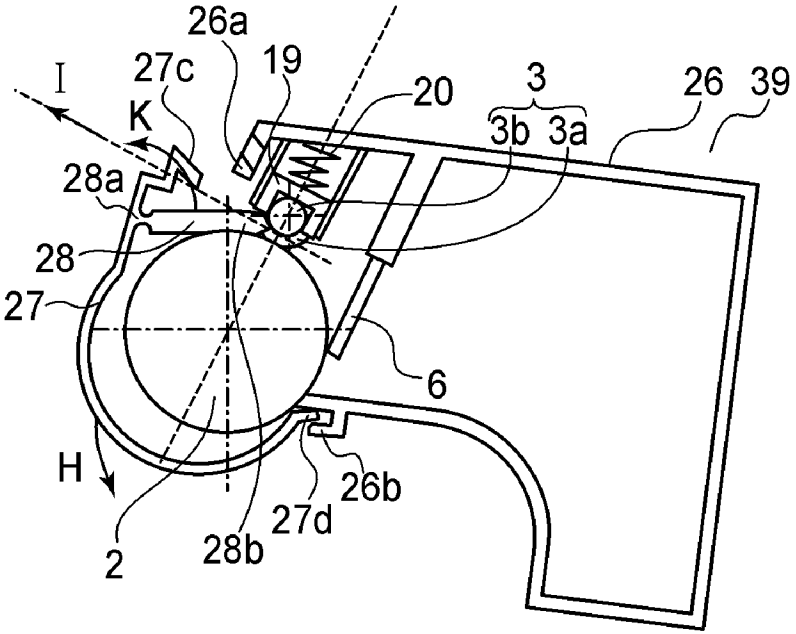

Referring to FIGS. 12C and 12D, in this embodiment, as the covering member 27 is rotationally moved in the direction H, the separation arms 28 are removed from between the photosensitive drum 2, and the rigid shaft 3*b* of the charge roller 3, whereby the charge roller 3, which was kept separated from the photosensitive drum 2, is placed in contact with the photosensitive drum 2. Further, the drum cartridge 39 is structured so that even when the drum cartridge 39 is in the state shown in FIGS. 12C and 12D, the separation arms 28 are rotatable relative to the covering member 27. Therefore, it does not occur that the separation arm 28 is pressed harder on the photosensitive drum 2 than it has been. Therefore, it does not occur that the separation arm 28 damages the photosensitive drum 2 and/or charge roller 3.

Further, the amount, by which the contact pressure between the separation arm 28 and photosensitive drum 2 is increased when the covering member 27 is moved for removal, can be reduced by giving the portion of the surface of the separating portion 25*b*, which contacts the peripheral surface of the photosensitive drum 2, a curvature which matches the curvature of the peripheral surface of the photosensitive drum 2, and the reduction in this amount can prevent the separation arm 28 and/or photosensitive drum 2 from being damaged when the covering member 27 is removed.

[Embodiment 3]

Figure 13:
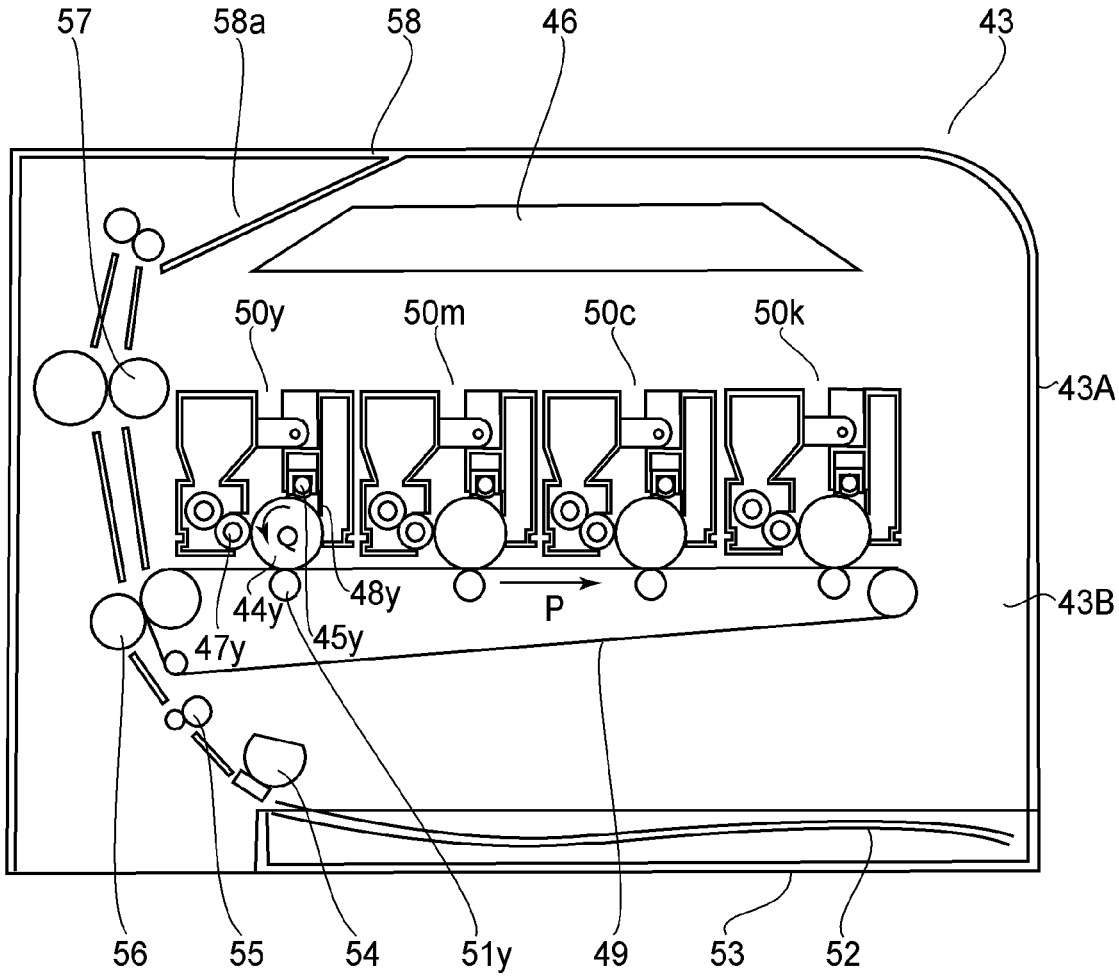
FIG. 13 is a schematic cross-sectional view of the image forming apparatus in the third preferred embodiment of the present invention.

Next, the embodiment of the present invention, in which the development unit and drum unit of the process cartridge are integrated, will be described. FIG. 13 is a cross-sectional view of the electrophotographic image forming apparatus and the process cartridges therein in this embodiment.

(Overall Structure of Image Forming Apparatus)

The image forming apparatus shown in FIG. 13 is an electrophotographic laser beam printer having first to fourth cartridges, which are disposed in tandem (in parallel, and in straight line) and in the horizontal direction.

The image forming apparatus 4 is designed so that the first to fourth process cartridges 50*y*, 50*m*, 50*c*, and 50*k*, which are different in toner color, are removably mountable in the preset process cartridge chambers (unshown), with which the apparatus main assembly 43A is provided. The first cartridge 50*y* is a yellow process cartridge, that is, a process cartridge in which yellow toner is stored. The second cartridge 50*m* is a magenta process cartridge, that is, a process cartridge in which magenta toner is stored. The third cartridge 50*c* is a cyan process cartridge, that is, a process cartridge in which cyan toner is stored. The fourth cartridge 50*k* is a black process cartridge, that is, a process cartridge which stores black toner.

In terms of the toner image forming means, the toner image forming means of the first to fourth cartridges 50*y*, 50*m*, 50*c*, and 50*k* are the same. Hereafter, therefore, their toner image forming means will be described with reference to the yellow process cartridge 50*y*.

The image forming apparatus 43 has a photosensitive drum 44*y*. It also has: a charging means 45*y* for uniformly charging the photosensitive drum 44*y*; an exposing means 46 for forming a latent image on the photosensitive drum 44*y*, by projecting a beam of laser light upon the photosensitive drum 44*y*; and a development roller 47*y*, which makes the latent image formed on the photosensitive drum 44*y*, visible by developing the latent image with a color toner, the color of which corresponds to the yellow component of the image to be formed; and a cleaning means 48*y* for removing the residual toner on the photosensitive drum 44*y*.

In this embodiment, the photosensitive drum 44*y*, charging means 45*y*, development roller 47*y*, and cleaning means 48*y* are integrally disposed in a cartridge, making up a cartridge 50*y*, which is removably mountable in the main assembly 43A of the image forming apparatus 43. The photosensitive drum 44*y*, charging means 45*y*, and cleaning means 48*y*, may be integrally placed in the same cartridge, or independently placed in their own cartridge.

First, the photosensitive drum 44*y* is rotated in the direction indicated by an arrow mark Q, in synchronism with an intermediary transfer belt 49, which is rotated in the direction indicated by an arrow mark P, while charging the peripheral surface of the photosensitive drum 44*y* of the yellow process cartridge 50*y* by the charging means 45*y*. Then, the charged portion of the peripheral surface of the photosensitive drum 44*y* is irradiated with the exposing means 46 to form an electrostatic latent image which corresponds to the yellow component of an intended full-color image, on the photosensitive drum 44*y*. Meanwhile, the photosensitive drum 44*y* and development roller 47*y* are made different in potential level so that the yellow developer will adhere to the latent image on the photosensitive drum 44*y*. As a result, the yellow developer adheres to the latent image on the photosensitive drum 44*y*; the latent image is developed. As a result, the yellow toner image, which corresponds to the yellow component of the intended full-color image, is formed on the photosensitive drum 44*y*. Thereafter, the yellow toner image on the photosensitive drum 44*y* is transferred (primary transfer) onto the intermediary transfer belt 49, by applying a voltage which is opposite in polarity to the toner, to a primary transfer roller 51*y* which is on the inward side of the loop which the intermediary transfer belt 49 forms.

The step for forming an electrostatic latent image, step for developing the electrostatic latent image, and step of transferring (primary transfer) of the developed latent image, are sequentially repeated in the process cartridges 50*m*, 50*c*, and 50*k* to form the magenta, cyan, and black monochromatic images, respectively, as the steps are carried out in the process cartridge 50*y*. As a result, yellow, magenta, cyan, and black toner images are placed in layers on the intermediary transfer belt 49, synthetically yielding thereby a single full-color image.

As for the sheet (recording medium) 52, onto which the toner images are to be transferred, multiple sheets 52 are stored in layers in a sheet feeder cassette 53, which is located in the bottom portion of the image forming apparatus. The multiple sheets 52 are fed out from the sheet feeder cassette 53 by a sheet feeder roller 54 while being separated one by one from the rest, and then, each is conveyed to a pair of registration rollers 55. As the fed sheet 52 is delivered to the registration rollers 55, the registration rollers 55 send the delivered sheet 52 to the secondary transfer portion, that is, the compression nip between the intermediary transfer belt 49 and secondary transfer roller 56. Further, a voltage, which is opposite in polarity to the toner charge is applied to the secondary transfer roller 56.

Thus, while the sheet 52 is conveyed through the secondary transfer portion, remaining sandwiched by the intermediary transfer belt 49 and secondary transfer roller 56, the four layers of monochromatic toner images, different in color, on the intermediary transfer belt 49 are transferred (secondary transfer) all together onto the surface of the sheet 52.

After the transfer (secondary transfer) of the toner images onto the sheet 52, the sheet 52 is separated from the intermediary transfer belt 49, and is sent to a fixing device 57. In the fixing device 57, the sheet 52 is subjected to heat and pressure, whereby the toner images are melted and permanently fixed to the sheet 52 while being mixed. As a result, a single full-color image is effected on the sheet 52. Thereafter, the sheet 52 is discharged from the fixing device 57 into a delivery portion 58*a*, which is an integral part of the outward surface of the top cover 58 of the image forming apparatus.

(Overall Structure of Process Cartridge)

Figure 14:
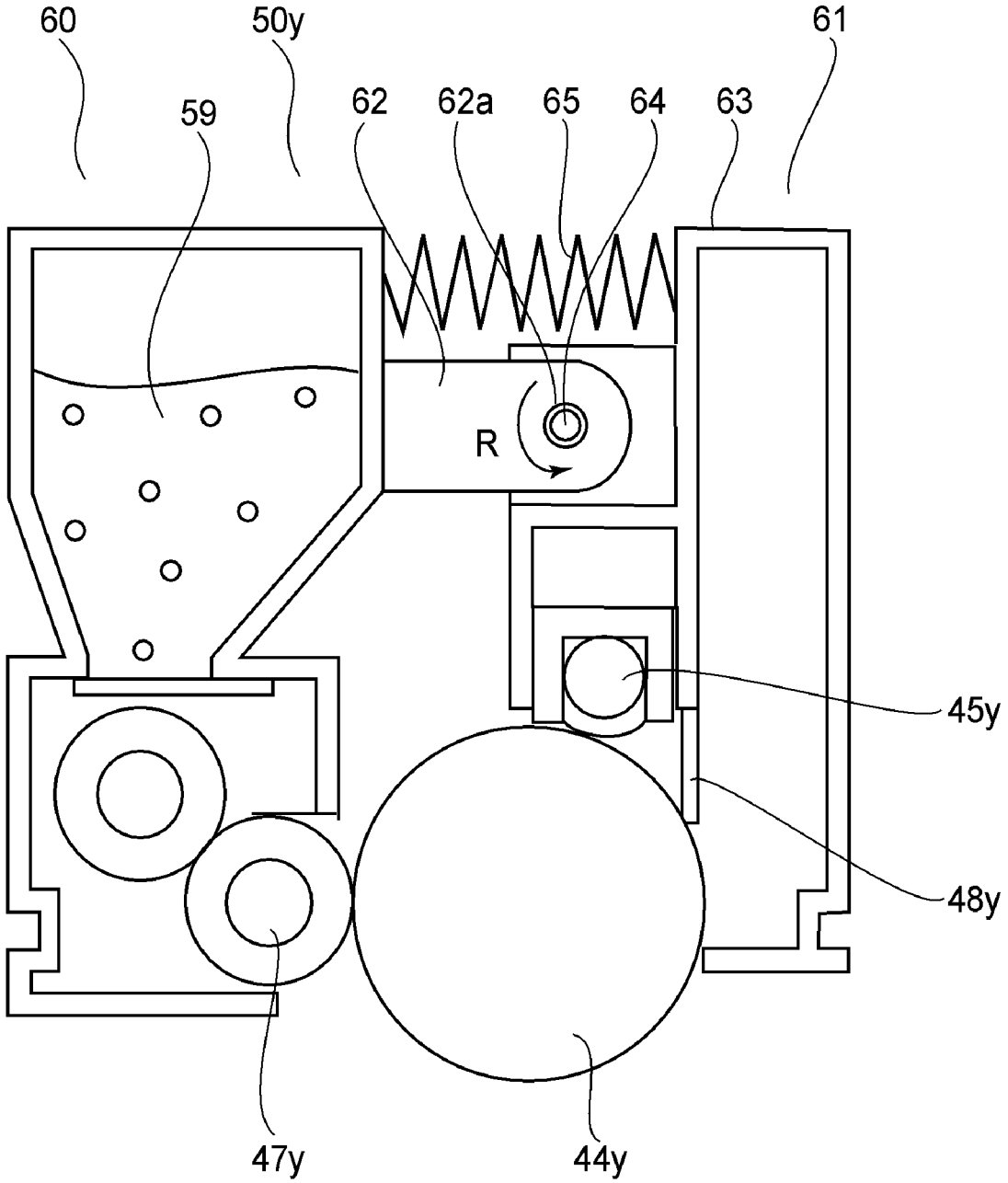
FIG. 14 is a schematic cross-sectional view of the process cartridge in the third preferred embodiment of the present invention.

Next, referring to FIG. 14, the process cartridge will be described.

The cartridge 50*y* is provided with processing means which process the photosensitive drum 44*y*. Here, the processing means are: the charging means 45*y* for charging the photosensitive drum 44*y*; development roller 47*y* as the developing means for developing a latent image formed on the photosensitive drum 44*y;* and a cleaning means 48*y* for removing the residual toner remaining on the peripheral surface of the photosensitive drum 44*y*. Further, the yellow process cartridge 50*y* is made up of a development unit 60 and a drum unit 61. The development unit 60 has the development roller 47*y*. The drum unit 61 has the photosensitive drum 44*y*, charging means 45*y*, and cleaning means 48*y*.

The development unit 60 has a pair of bearings 62, each of which has a hole 62*a*. The hole 62*a* may be provided as a part of one of the structural components of the development unit 60 other than the bearing 62. On the other hand, the cleaning means container 63 of the drum unit 61, which is a part of the frame of the drum unit 61, is provided with a pair of shafts 64, which fit, one for one, into the abovementioned pair of holes 64*a* of the development unit 60. The shafts 64 may be parts of one of the structural components of the drum unit 61 other than the cleaning means container 63. The development unit 60 is connected to the drum 61 in such a manner than it is rotationally movable relative to the drum unit 61 about the shafts 64.

While the cartridge 50*y* is used for image formation, the development roller 47*y* of the development unit 60 remains in contact with the photosensitive drum 44*y*, because the development unit 60 is under the pressure from a pair of compression springs 65, which keep the development unit 60 pressed in such a direction that the development unit 60 rotationally moves in the direction indicated by an arrow mark R about the pair of shafts 64.

That is, the cartridge 50*y* has: the drum unit 61, which has at least the photosensitive drum 44*y*; and the development unit 61, which has at least the development roller 47*y* for developing the electrostatic latent image formed on the photosensitive drum 44*y*, and is capable of moving relative to the development unit 60. Further, the development unit 60 is enabled to take the contact position, in which its development roller 47*y* remains in contact with the photosensitive drum 44*y*, and the non-contact position, in which its development roller 47*y* remains separated from the photosensitive drum 44*y*. The cartridge 50*y* is removably mounted in one of the cartridge chambers designated for the cartridges 50 in the main assembly 43A.

(Structure of Development Unit 60)

Figure 15B:
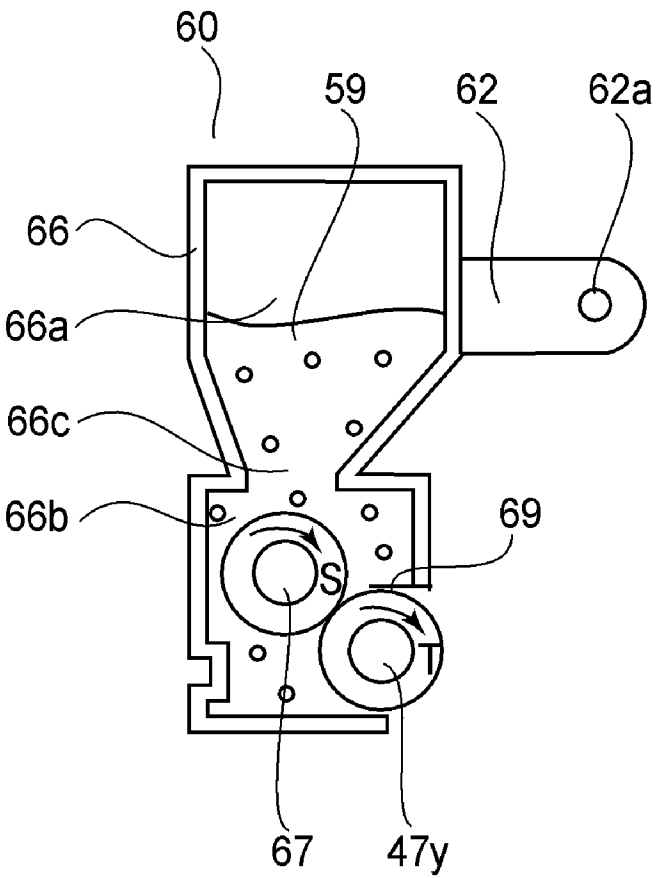
FIG. 15 is a schematic cross-sectional view of the development unit of the process cartridge.
Figure 15A:
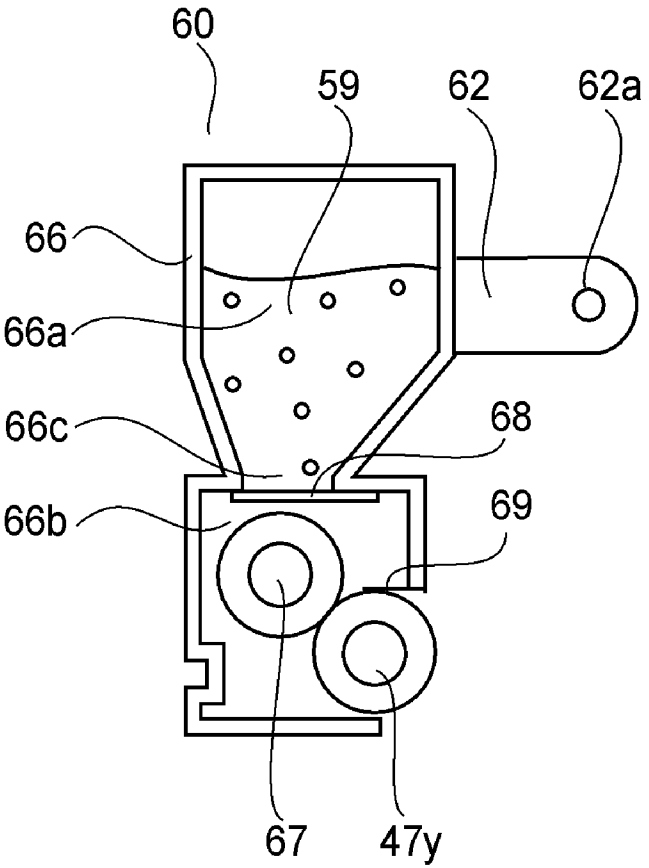

Next, referring to FIG. 15, the development unit 60 will be described. FIG. 15 is a cross-sectional view of the development unit 60 in this embodiment. The developing means container 66 of the development unit 60 is made up of a toner storage chamber 66*a*, and a development chamber 66*b* in which the development roller 47*y*, a toner supply roller 67, etc., are disposed. The toner storage chamber 66*a* is on top of the development chamber 66*b*. The two chambers 66*a* and 66*b* are in connection to each other through a toner supply passage 66*c*. Referring to FIG. 15A, until the development unit 60 reaches a user, more specifically, until the cartridge 50*y* is used for the first time, the toner supply passage 66*c* remains blocked by a toner seal 68 (piece of film), which is attached to the edge of the toner supply passage 66*c* by thermal welding or the like method. In other words, until the cartridge 50*y* is used for the first time, the toner storage chamber 66*a* and development chamber 66*b* remain separated by the toner seal 68, which is to be removed before the cartridge 50*y* is used for the first time. As the toner seal 68 is removed, the toner 59 in the toner storage chamber 66*a* naturally falls into the development chamber 66*b,* as shown in FIG. 15B. The toner 59 in the development chamber 66*b* is supplied to the toner supply roller 67, which supplies the development roller 47*y* with the toner 59 by being rotated in the direction indicated by an arrow mark S in FIG. 15B.

The development roller 47*y* is made up of a rubber roller 47*a* (roller made of rubber) and a rigid shaft 47*b*. The rigid shaft 47*b* is put through the rubber roller 47*a*, from one lengthwise end of the rubber roller 47*a* to the other, in the direction parallel to the axial line of the photosensitive drum 44*y*. The lengthwise ends 47*b*1 and 47*b*2 of the rigid shaft 47*b* extend from the lengthwise ends of the rubber roller 47*a*, one for one.

The development roller 47*y* rotates in the direction indicated by an arrow mark T in FIG. 15B. As the development roller 47*y* rotates, the body of toner 59 on the development roller 47*y* is regulated in thickness by a development blade 69, and then, is adhered to the photosensitive drum 44*y*, developing the latent image on the photosensitive drum 44*y*. The toner 59 remaining on the development roller 47*y* after the development is removed by the toner supply roller 67. Therefore, the development roller 47*y* is supplied with a fresh supply of the toner 59 by the toner supply roller 67.

(Structure of Drum Unit 61)

Figure 17:
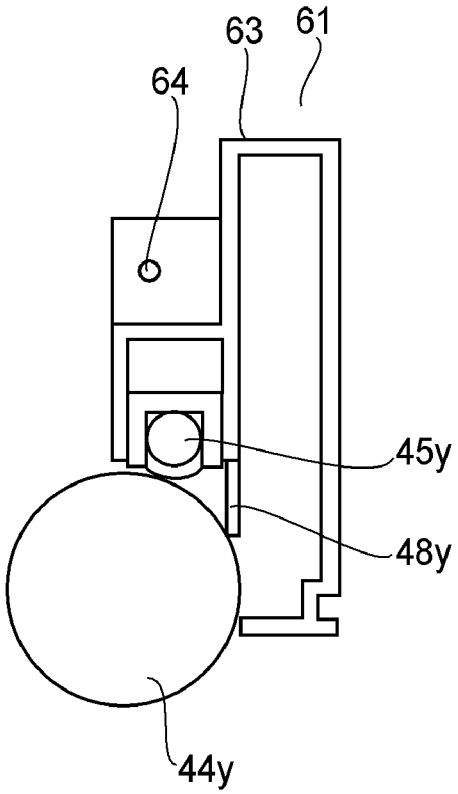
FIG. 17 is a schematic cross-sectional view of the drum unit of the process cartridge.

Next, referring to FIG. 17, the drum unit 61 will be described. FIG. 17 is a cross-sectional view of the drum unit 61 in this embodiment. The drum unit 61 is an integration of the photosensitive drum 44*y,* charging means 45*y*, and cleaning means 48*y*. The charging means 45*y* uniformly charges the photosensitive drum 44*y* before the formation of a latent image. The cleaning means 48*y* removes the transfer residual toner, and stores the removed residual toner in the cleaning means container 63.

(Drum Protecting Covering Member and Separating Member)

Figure 18:
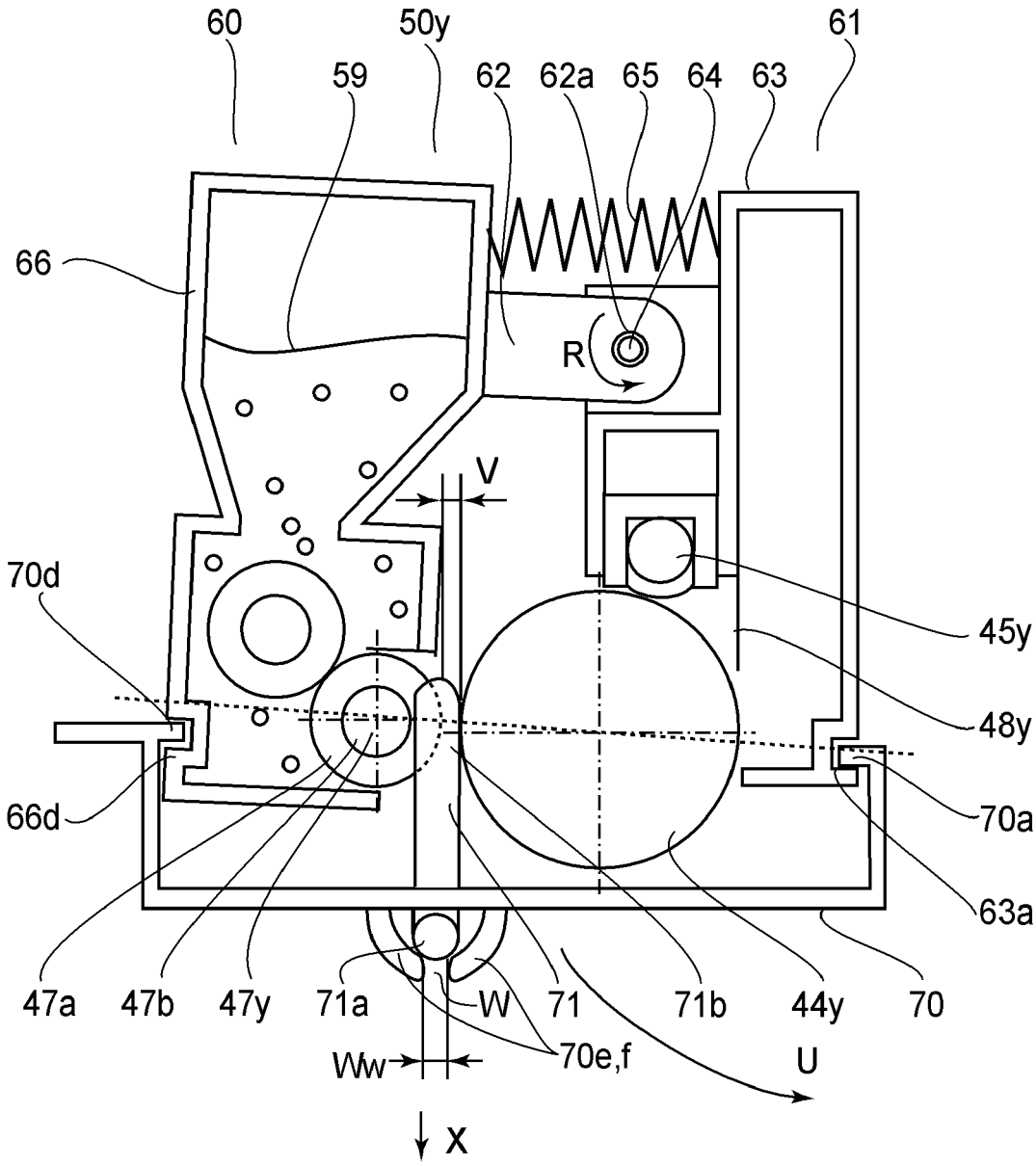
FIG. 18 is a schematic cross-sectional view of the process cartridge, in the third preferred embodiment of the present invention, the covering member and separating member of which have not been removed.

Next, referring to FIGS. 18 and 19, the covering member for protecting the photosensitive drum 44*y*, and a separating member for keeping the development roller 47*y* separated from the photosensitive drum 44*y*, will be described. FIG. 18 is a cross-sectional view of the cartridge 50*y* before the removal of the drum protecting covering member and separating member.

In order to develop an electrostatic latent image formed on the peripheral surface of the photosensitive drum 44*y*, and to transfer the toner image developed on the peripheral surface of the photosensitive drum 44*y*, the peripheral surface of the photosensitive drum 44*y* in the above described drum unit 61 has to be widely exposed. However, the operation for exchanging the cartridge 50*y* is done by a user him- or herself. Thus, it is possible that the photosensitive drum 44*y* will be damaged between when the cartridge 50*y* is shipped out and when the cartridge 50*y* is mounted into the image forming apparatus 48. Therefore, in order to keep the photosensitive drum 44*y* protected while the cartridge 50*y* remains unused, more specifically, before the cartridge 50*y* reaches a user, in particular, while the cartridge 50*y* is commercially distributed, it is necessary that a removable covering member 70 is attached to the cartridge 50*y*.

The covering member 70 is a member which is removably attached to the process cartridge 50, which is removably mountable in the main assembly 43 of the electrophotographic image forming apparatus 43, to cover the peripheral surface of the photosensitive drum 44*y*. More specifically, the covering member 70 is provided with first and second anchoring portions 70*a* and 70*d*, which are engaged with the covering member retaining portion 63*a*, with which the cleaning means container 63*a* (which is part of the drum unit frame) is provided, and the covering member retaining portion 63*d*, with which the developing means container 66 (which is part of the development unit frame) is provided, respectively. Thus, the covering member 70 remains attached to the cartridge 50*y*. The covering member retaining portion 63*a* for keeping the covering member 70 attached to the cartridge 50*y* may be formed as a part of one of the portions of the drum unit 61 other than the cleaning means container 63. Further, the covering member retaining portion 66*d* may be formed as a part of one of the portions of the development unit 60 other than the developing means container 66.

The method for removing the covering member 70 from the process cartridge 50*y* is as follows: First, the anchoring portion 70*d*, which is in engagement with the covering member retaining portion 66*d*, is to be disengaged from the covering member retaining portion 66*d*, and then, the covering member 70 is to be rotationally moved about the anchoring portion 70*a*, so that the covering member 70 can be removed from the process cartridge 50*y* in the direction indicated by an arrow mark U in FIG. 18.

Figure 16:
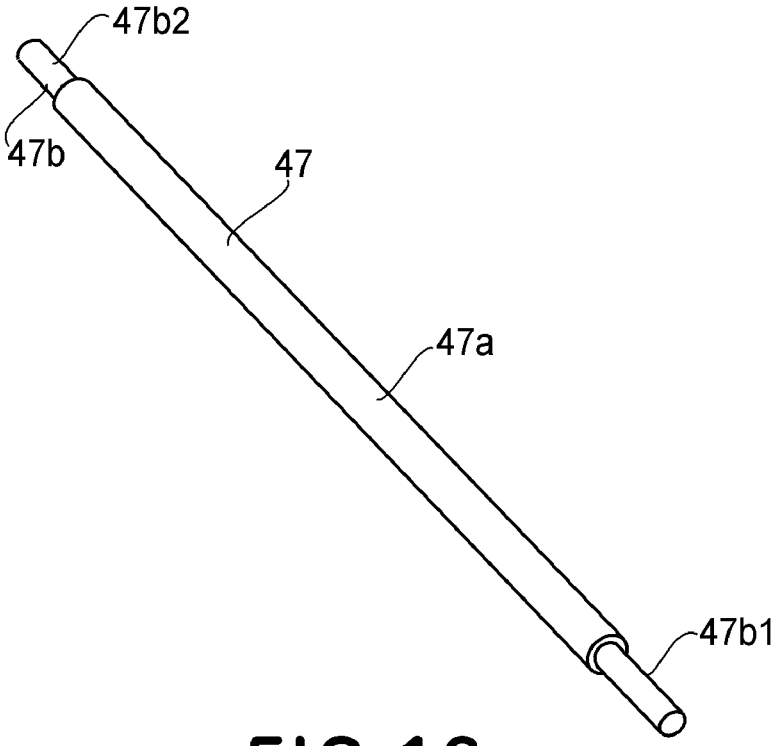
FIG. 16 is a perspective view of the development roller.

The development roller 47*y* is kept pressed upon the photosensitive drum 44*y* by the pair of compression springs 65. Thus, it is possible that the rubber roller 47*a* of the development roller 47*y* will be deformed by the time the process cartridge 50*y* is delivered to a user. Therefore, in order to prevent the development roller 47*y* from being deformed before the process cartridge 50*y* reaches a user, more specifically, before the cartridge 50*y* is used for the first time, it is necessary for the development roller 47*y* to be kept separated from the photosensitive drum 44*y* until the cartridge 50*y* is used for the first time. In this embodiment, a pair of separating members 71 are placed between the aforementioned rigid shaft 47*b* of the development roller 47*y*, and the peripheral surface of the photosensitive drum 44*y*, in order to keep a distance (gap) V between the peripheral surface of the photosensitive drum 44*y* and rubber roller 47*a*. That is, the separating member 71 is inserted between the peripheral surface of the photosensitive drum 44*y*, and the rigid shaft 47*b* of the development roller 47*y*, to keep the development roller 47*y* separated from the peripheral surface of the photosensitive drum 44*y*. This structural arrangement prevents the development roller 47*y* from being deformed before the cartridge 50*y* is delivered to a user, more specifically, before the cartridge 50*y* is used for the first time. Also in this embodiment, two separating members 71 are employed, which are placed at the lengthwise ends of the covering member 70, one for one, in terms of the direction parallel to the axial line of the photosensitive drum 44*y*. More concretely, one of the separating members 71 is placed between the lengthwise end portion 47*b*1 (FIG. 16) of the rigid shaft 47*b*, and the photosensitive drum 44*y*, and the other separating member 71 is placed between the lengthwise end portion 47*b*2 (FIG. 16), and the photosensitive drum 44*y*. However, the cartridge 50*y* may be structured to employ only one separating member 71, which is inserted between the photosensitive drum 44*y*, and either lengthwise end portion 47*b*1 or 47*b*2 of the development roller 47*y*. Further, in terms of the direction parallel to the axial line of the photosensitive drum 44*y*, the separating member 71 is placed on the outward side of the cleaning means 48*y*. Further, in terms of the direction perpendicular to the axial line of the photosensitive drum 44*y*, the separating member 71 is between the first and second anchoring portions 70*a* and 70*d*.

Figure 19:
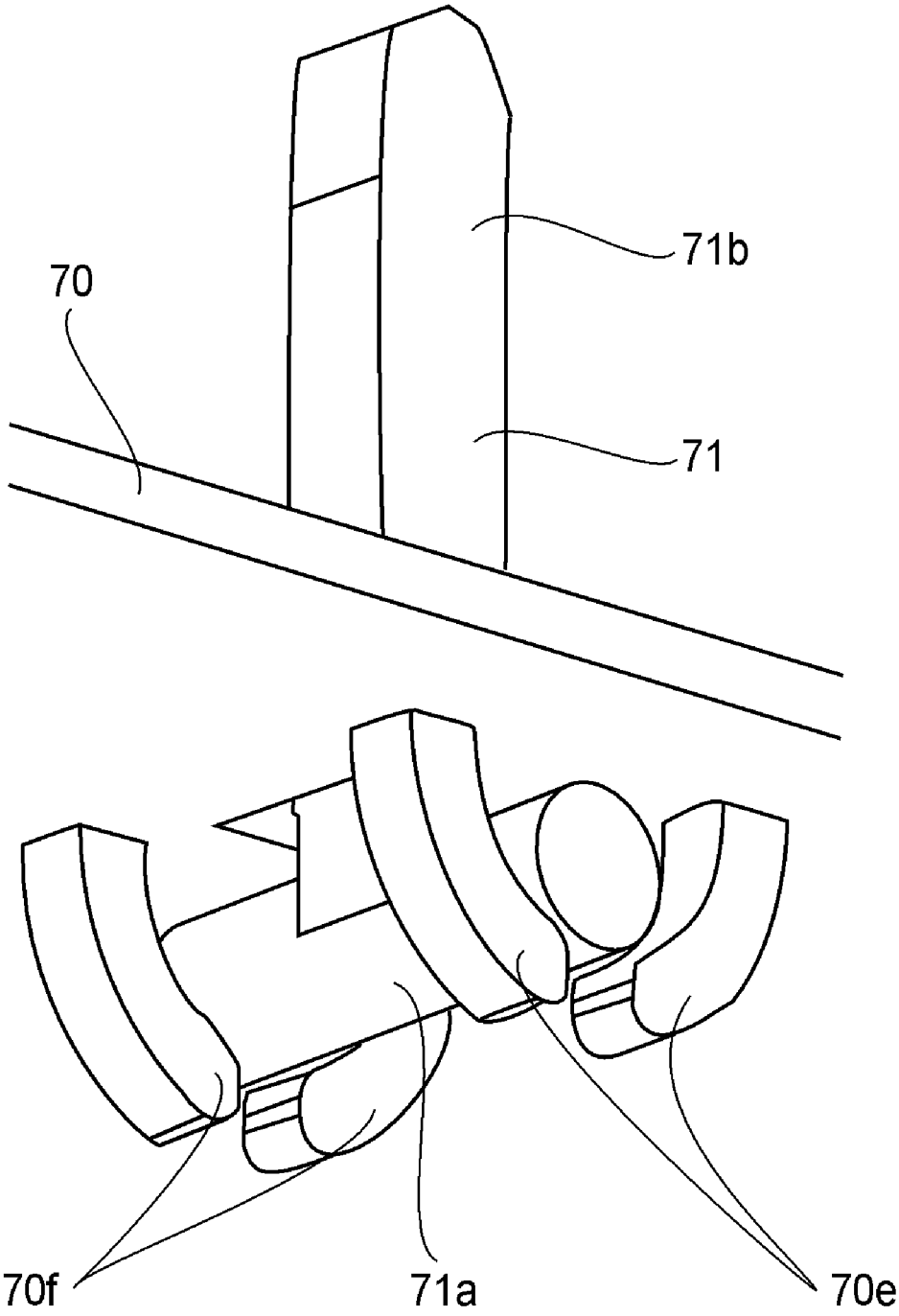
FIG. 19 is a perspective view of the joint between the covering member and separating member in the third preferred embodiment of the present invention.

Referring to FIGS. 18 and 19, each separating member 71 has a cylindrical shaft 71*a* and a separating portion 71*b*. As the shaft 71*a* of the separating member 71 is engaged with the separating member retaining portions 70*e* and 70*e* of the covering member 70, the separating member 71 is movably supported by the covering member 70. Further, there is a slit W between the two arcuate portions of the retaining portion 70*e*, and between the two arcuate portions of the retaining portion 70*f*. The slit width Ww is slightly narrower than the diameter d of the shaft 71*a*. Normally, therefore, the separating member 71 does not disengage from the covering member 70, although it can be disengaged from the covering member 70. That is, the separating member 71 is removable from the covering member 70, and is held to the covering member 70 so that it is movable relative to the covering member 70. Further, referring to FIG. 21, the height H2 of the inward side of each of the retaining portions 70*e* and 70*d*, and the width W2 between the two portions of each of the retaining portions 70*e* and 70*d*, are greater than the diameter d2 of the shaft 71*a*, because of the following reason (which will be described later in more detail): Affording the separating member 71 and covering member 70 more latitude in their movement relative to each other can reduce the amount of force necessary to remove the covering member 70 and also, can prevent the photosensitive drum 44*y*, etc., from being damaged during the removal of the covering member 70.

(Removal of Covering Member 70 and Separating Member 71)

Next, referring to FIGS. 18-22, the removal of the covering member 70 and separating member 71 will be described.

Basically, the direction in which the separating member 71 is to be moved to remove the separating member 71 is desired to be perpendicular to the line which connects the center of the photosensitive drum 44*y* and the center of the development roller 47*y*. That is, it is desired to be the direction indicated by an arrow mark X in FIG. 18. In order to allow the separating member 71 to be removed in the direction indicated by the arrow mark X, it is necessary that the covering member 70 also can be removed in the direction X.

Figure 21A:
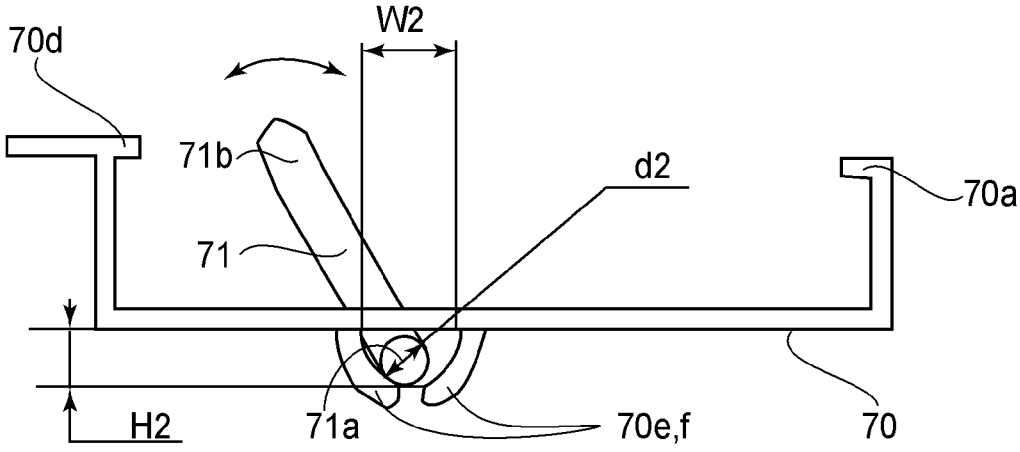
FIGS. 21A and 21B are cross-sectional views of the covering member and separating member, which are for describing the structural arrangement for keeping connected the covering member and separating member in the third preferred embodiment.
Figure 21B:
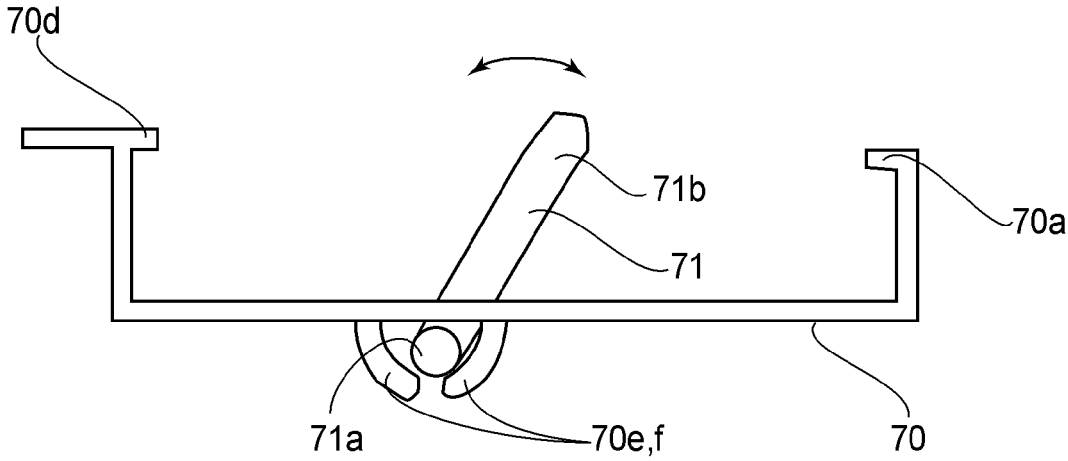

Referring to FIGS. 18, 19, and 21, in this embodiment, therefore, the separating member 71 is supported by the covering member 70 in such a manner that the separating member 71 is enabled to move relative to the covering member 70.

Next, referring to FIGS. 22A-22D, as a user moves the covering member 70 in the direction indicated by the arrow mark U to remove the covering member 70, the separating member 71 moves relative to the covering member 70. To describe the initial stage of the operation for removing the covering member 70 from the developing means container 66 and cleaning means container 63, as the covering member 70 is moved in the direction indicated by the arrow mark U, each separating member 71 rotationally moves relative to the covering member 70 in the direction indicated by the arrow mark U while remaining pinched between the photosensitive drum 44*y*, and the rigid shaft 47*b* of the development roller 47*y* (developing means). Here, the direction Z in which the separating member 71 rotationally moves is opposite to the direction U in which the covering member 70 is to be rotationally moved in order to remove the covering member 70 from the developing means container 66. The employment of this structural arrangement can significantly reduce the amount of force necessary to remove the covering member 70 equipped with the separating members 71, and also, can prevent the photosensitive drum 44*y* and development roller 47*y* from being damaged when the covering member 70 is removed.

In a case of the structural arrangement which solidly attaches the separating member 71 to the covering member 70, when the covering member 70 is removed from the cleaning means container 63, the covering member 70 is rotationally moved in the direction U. Therefore, as the covering member 70 is moved, the development unit 60 having the development roller 47*y* is pushed in the clockwise direction in FIG. 22A. Therefore, the development roller pressing member 65 is more compressed than it is in the state shown FIG. 22A. Thus, the amount of force necessary to remove the covering member 70 is increased. Moreover, the separating member 71 is pressed upon the photosensitive drum 44*y*, and the rigid shaft 47*b* of the development roller 47*y*, by a greater amount of force, making it possible for the photosensitive drum 44*y* and development roller 47*y* to be damaged.

Figure 22B:
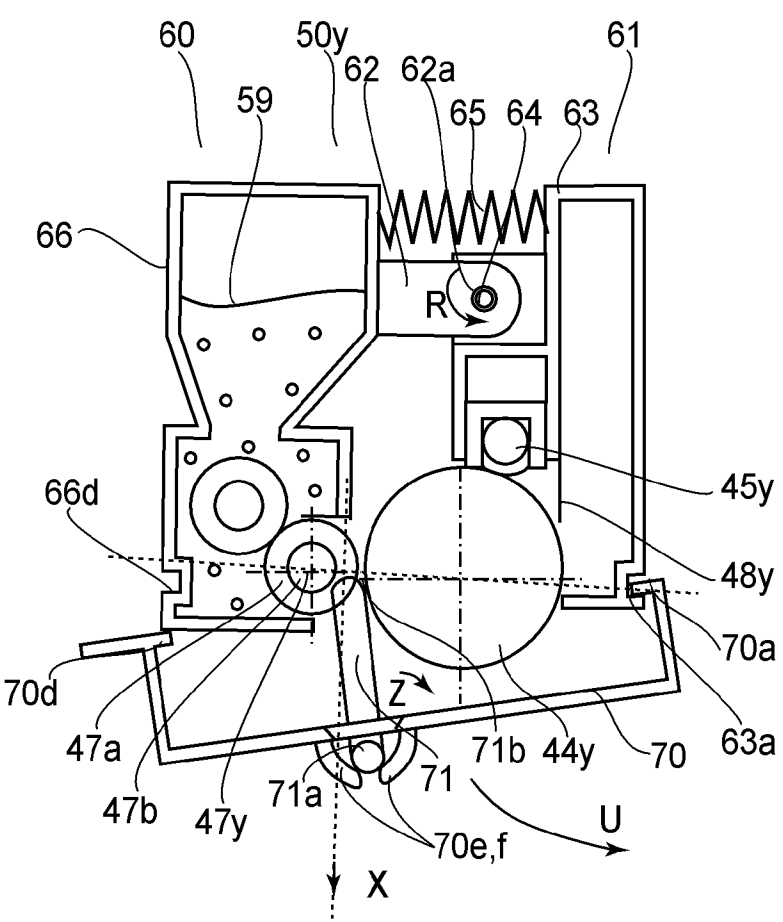
FIGS. 22A-22D are drawings for describing the steps for disengaging the covering member and separating member from the cartridge, in the third preferred embodiment.
Figure 22A:
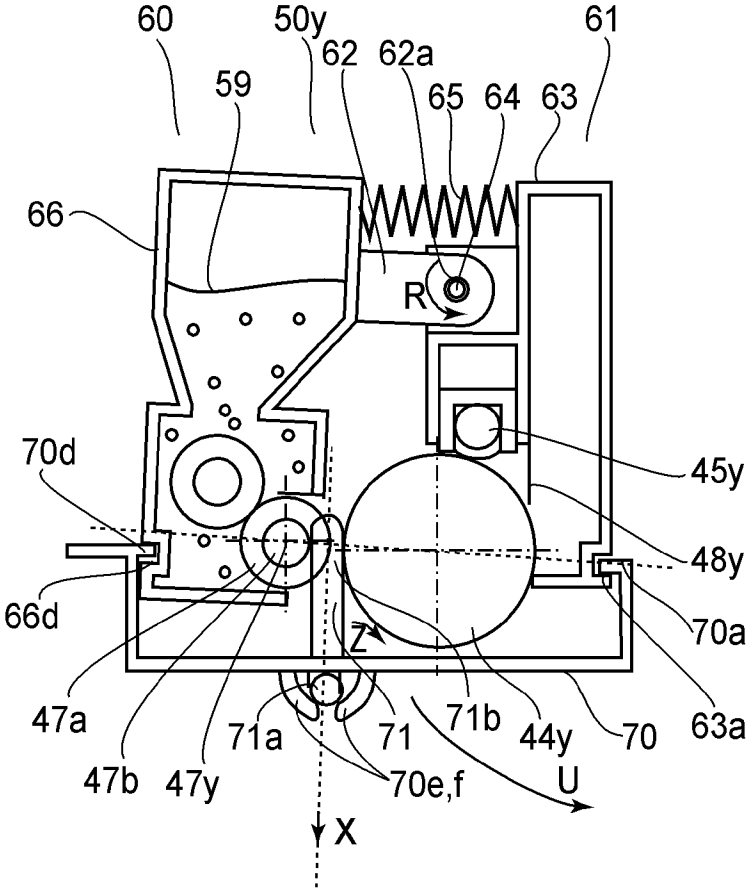
Figure 22D:
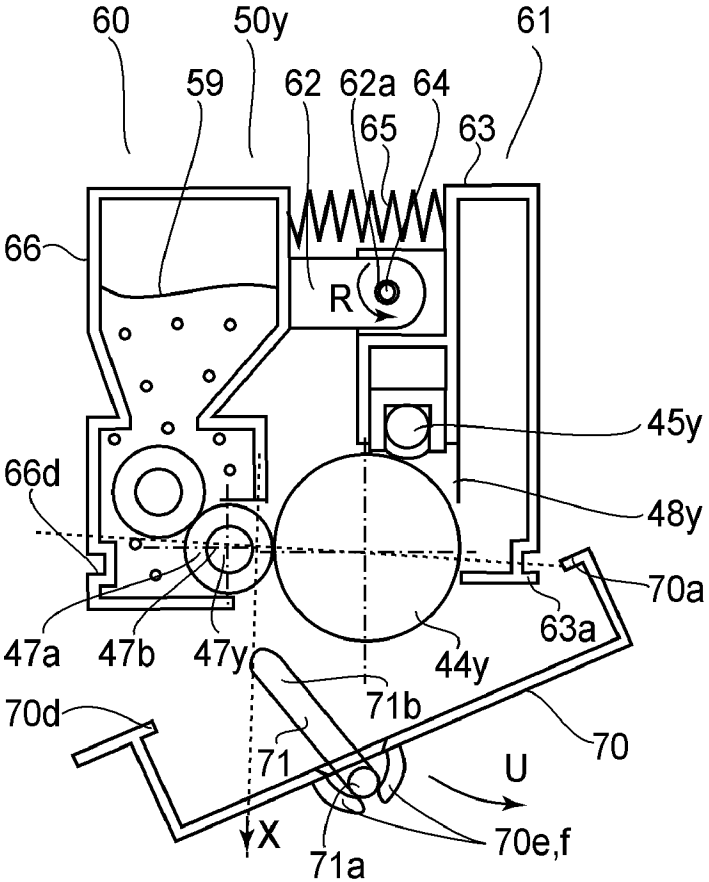
Figure 22C:
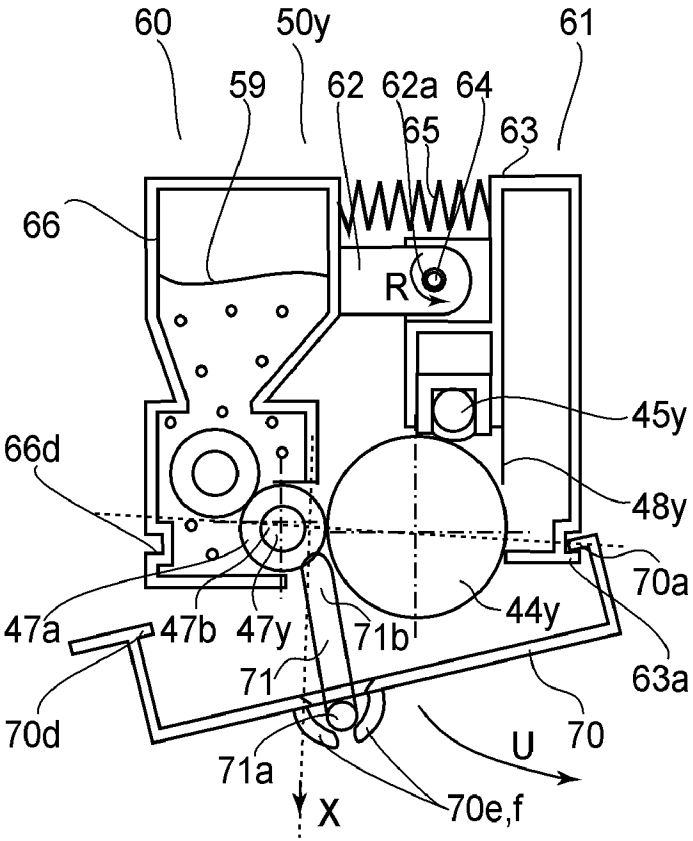

Referring to FIGS. 22C and 22D, in this embodiment, each separating member 71 is removed from between the photosensitive drum 44*y*, and the rigid shaft 47*b* of the development roller 47*y*, by rotationally moving the covering member 70 further in the direction U. As the separating member 71 is removed, the development roller 47*y*, which was kept separated from the photosensitive drum 44*y*, is placed in contact with the photosensitive drum 44*y*. Further, the cartridge 50*y* is structured so that even when the process cartridge 50*y* is in the state shown in FIGS. 22C and 22D, the separating member 71 is rotatable relative to the covering member 70. Therefore, it does not occur that when the covering member 70 is removed, the separating member 71 is pressed harder on the photosensitive drum 44*y* than it has been. Therefore, it does not occur that the separating member 71 damages the photosensitive drum 44*y*.

Next, referring to FIG. 21, the height H2 and width W2 of the inward side of each of the retaining portions 70*e* and 70*d* were made greater than the diameter d2 of the shaft 71*a*, by an amount large enough to provide a substantial amount of play. This structural arrangement makes it possible to allow the separating member 71 to move relative to the covering member 70 in the radius direction of the shaft 71*a*. Therefore, it can further reduce the amount of force necessary to remove the covering member 70, and also, can prevent the photosensitive drum 44*y*, etc., from being damaged when the covering member 70 is removed.

Further, the amount, by which the contact pressure between the separating portion 71*b* of the separating member 71, and the peripheral surface of the photosensitive drum 44*y*, is increased when the covering member 70 is removed, can be reduced by giving the portion of the surface of the separating portion 71*b*, which contacts the peripheral surface of the photosensitive drum 44*y*, a curvature which matches the curvature of the peripheral surface of the photosensitive drum 44*y*. The reduction in this amount can prevent the separating member 71 and/or photosensitive drum 44*y* from being damaged.

[Embodiment 4]

Figure 23:
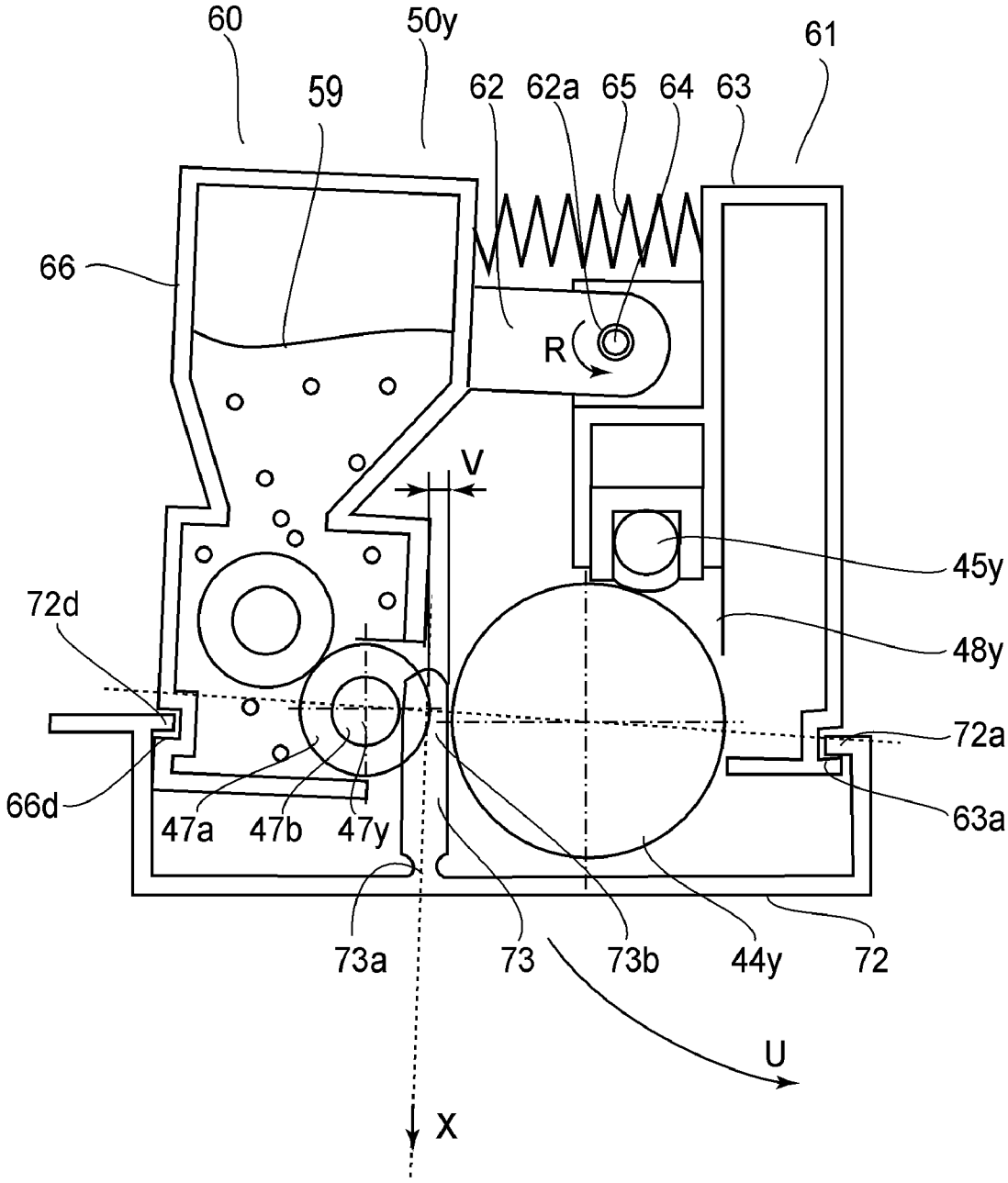
FIG. 23 is a schematic cross-sectional view of the process cartridge, in the fourth preferred embodiment of the present invention, the covering member and separating member of which have not been removed.

Next, an embodiment of a process cartridge, the separating member of which is a part of the covering member, or vice versa, will be described. FIG. 23 is a cross-sectional view of the process cartridge in this embodiment before the removal of its covering member. The components, portions, etc., of the process cartridge, which are the same in description as those in the third preferred embodiment, will be give the same referential codes, respectively, as those given to describe the third preferred embodiment, and will not be described here.

(Covering Member with Separating Member)

A covering member 72 is provided with first and second anchoring portions 72*a* and 72*d*, which are engaged with the covering member retaining portion 63*a*, with which the cleaning means container 63 is provided, and the covering member retaining portion 63*d*, with which the developing means container 66 is provided, respectively. With the engagement of the first and second anchoring portions 72*a* and 72*d* with the covering member retaining portions 63*a* and 63*d*, respectively, the covering member 72 remains attached to the cartridge 50*y*, protecting thereby the photosensitive drum 44*y* until the cartridge 50*y* is delivered unused to a user, in particular, during the commercial distribution of the cartridge 50*y*. The retaining portion 63*a* for keeping the covering member 72 attached to the cartridge 50*y* may be formed as a part of one of the portions of the drum unit 61 other than the cleaning means container 63. Further, the retaining portion 66*d* may be formed as a part of one of the portions of the development unit 60 other than the developing means container 66.

The method for removing the covering member 72 from the cartridge 50*y* is as follows: First, the anchoring portion 72*d*, which is in engagement with the retaining portion 66*d*, is to be disengaged from the retaining portion 66*d*, and then, the covering member 72 is to be rotationally moved about the anchoring portion 72*a* in the direction indicated by an arrow mark U.

In this embodiment, the covering member 72 has a pair of separation arms 73. Each separation arm 73 is attached to the cartridge 50*y* in such a manner that the separation arm 73 is placed between the aforementioned rigid shaft 47*b* of the development roller 47*y*, and the peripheral surface of the photosensitive drum 44*y*, in order to keep a distance (gap) V between the peripheral surface of the photosensitive drum 44*y* and rubber roller 47*a*. That is, the separation arm 73 is inserted between the peripheral surface of the photosensitive drum 44*y*, and the rigid shaft 47*b* of the development roller 47*y*, to keep the development roller 47*y* separated from the peripheral surface of the photosensitive drum 44*y*. This structural arrangement prevents the development roller 47*y* from being deformed before the cartridge 50*y* is delivered unused to a user, more specifically, before the cartridge 50*y* is used for the first time. Also in this embodiment, two separation arms 73 are employed, which are placed at the lengthwise ends of the covering member 72, one for one, in terms of the direction parallel to the axial line of the photosensitive drum 44*y*. More concretely, one of the separation arms 73 is placed between the lengthwise end portion 47*b*1 (FIG. 16) of the rigid shaft 47*b*, and the photosensitive drum 44*y*, and the other separation arm 73 is placed between the lengthwise end portion 47*b*2 (FIG. 16), and the photosensitive drum 44*y*. However, the cartridge 50*y* may be structured to employ only one separation arm 73, which is inserted between the photosensitive drum 44*y*, and either lengthwise end portion 47*b*1 or 47*b*2. Further, in terms of the direction parallel to the axial line of the photosensitive drum 44*y*, the separation arm 73 is placed on the outward side of the cleaning means 48*y*. Further, in terms of the direction perpendicular to the axial line of the photosensitive drum 44*y*, the separation arm 73 is between the first and second anchoring portions 72*a* and 72*d*.

Figure 24A:
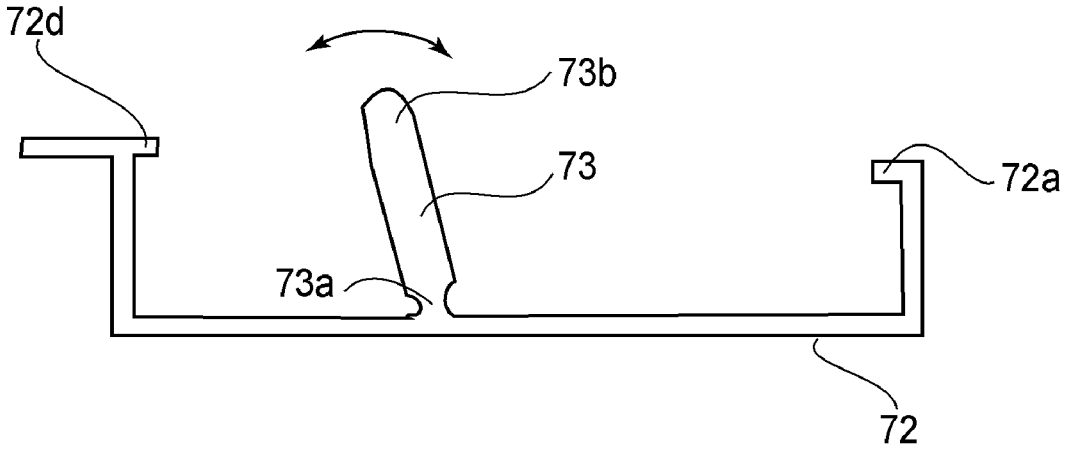
FIGS. 24A and 24B are drawings for describing the structural arrangement for keeping connected the covering member and separating member, in the fourth preferred embodiment of the present invention.
Figure 24B:
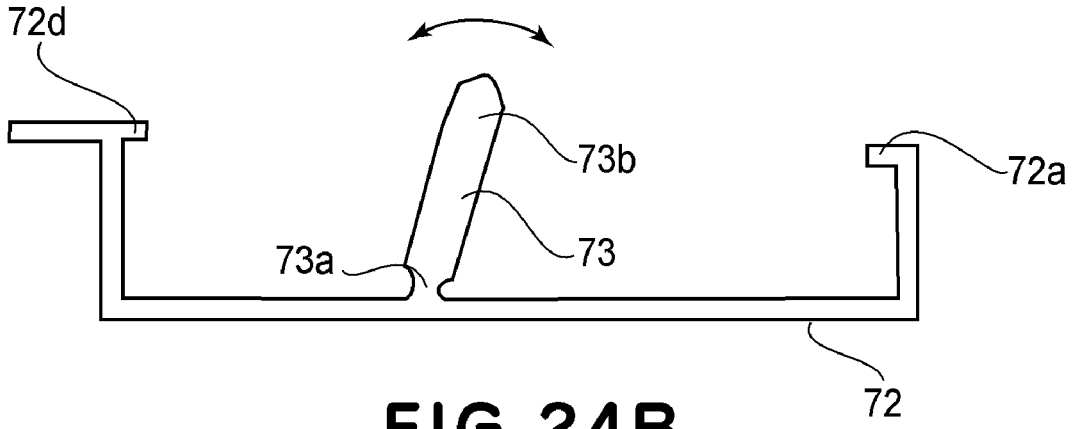

The separation arm 73 has at least one or more hinge-like portion 73*a*, and a separating portion 73*b*. The provision of the hinge-like portion 73*a* allows the separation arm 73 to move relative to the covering member 72, as shown in FIG. 24. More concretely, the covering member 72 is formed of a resinous substance, such as PP (polypropylene), and the hinge-like portion 73*a* is made thinner than the separation arm 73, being enabled to function like a hinge.

Figure 20B:
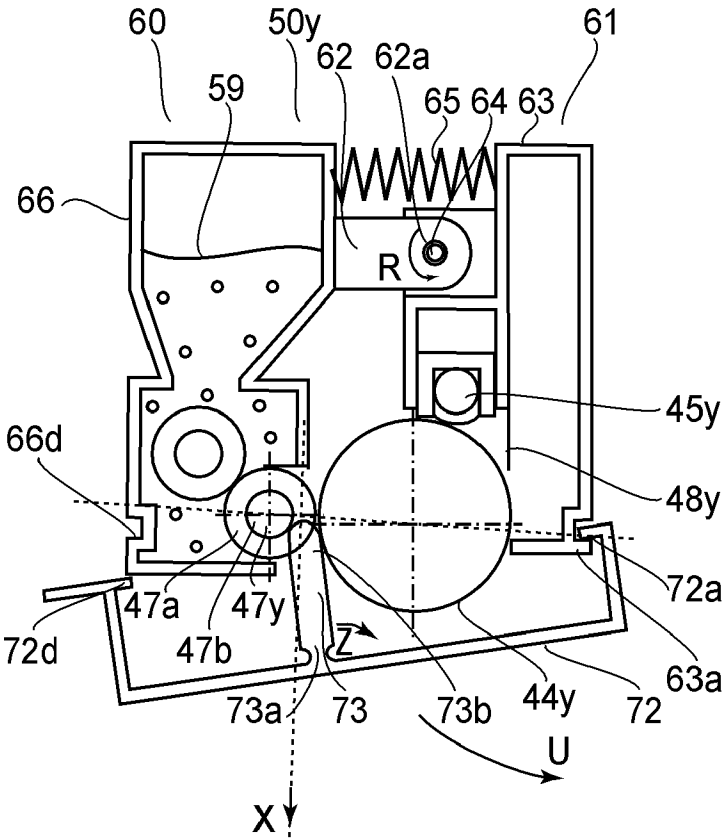
FIGS. 20A-20D are drawings for describing the steps for disengaging the covering member and separating member from the cartridge, in the fourth preferred embodiment.
Figure 20A:
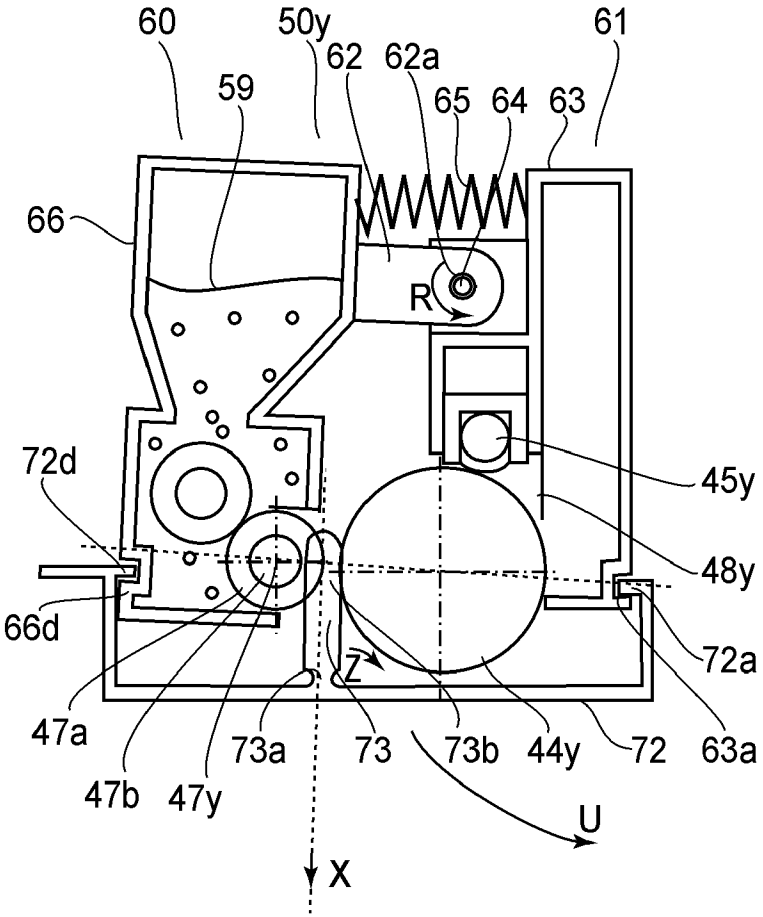

Referring to FIGS. 20A and 20B, in this embodiment, as a user moves the covering member 72 in the direction indicated by an arrow mark U, the separating portion 73*b* moves relative to the covering member 72. To describe the initial stage of the operation for removing the covering member 72 from the developing means container 66 and cleaning means container 63, the separating portion 73*b* of the separation arm 73 rotationally moves relative to the covering member 72 in the direction indicated by an arrow mark Z, as shown in FIGS. 20A and 20B, while remaining pinched between the photosensitive drum 44*y*, and the rigid shaft 47*b* of the development roller 47*y*. Here, the direction Z in which the separating portion 73*b* of the separation arm 73 rotationally moves is opposite to the direction U in which the covering member 72 is to be rotationally moved in order to remove the covering member 72 from the developing means container 66. The employment of this structural arrangement can significantly reduce the amount of force necessary to remove the covering member 72 having the separation arm 73, and also, can prevent the photosensitive drum 44*y* and development roller 47*y* from being damaged when the covering member 72 is removed.

Figure 20D:
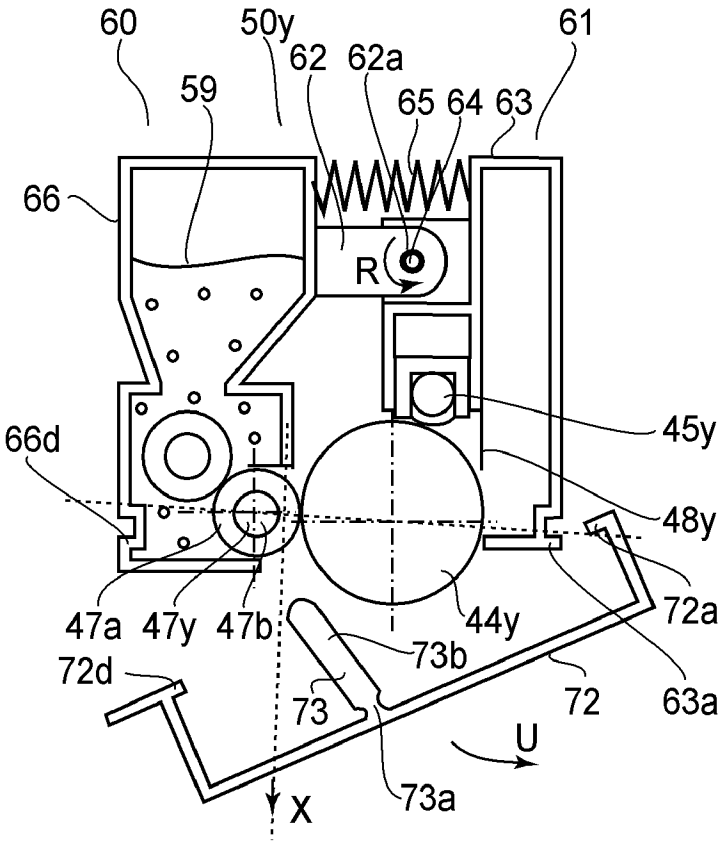
Figure 20C:
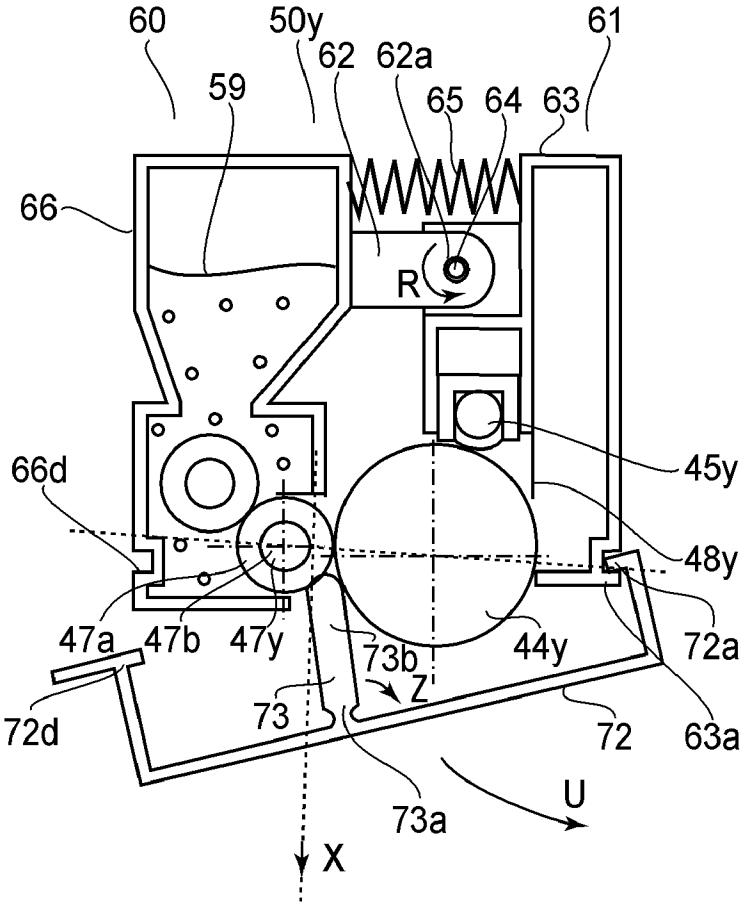

Referring to FIGS. 20C and 20D, in this embodiment, as the covering member 72 is rotationally moved further in the direction U, the separation arm 73 is removed from between the photosensitive drum 44*y*, and the rigid shaft 47*b* of the development roller 47*y*, whereby the development roller 47*y*, which was kept separated from the photosensitive drum 44*y*, is placed in contact with the photosensitive drum 44*y*. Further, the cartridge 50*y* is structured so that even when it is in the state shown in FIGS. 20C and 20D, the separation arm 73 is enable to move relative to the covering member 72. Therefore, it does not occur that when the covering member 72 is removed, the separation arm 73 is pressed harder on the photosensitive drum 44*y* than it has been. Therefore, it does not occur that the separation arm 73 damages the photosensitive drum 44*y*.

Further, the amount, by which the contact pressure between the separating portion 73*b* of the separation arm 73, and the peripheral surface of the photosensitive drum 44*y* is increased when the covering member 72 is moved for removal, can be reduced by giving the portion of the surface of the separating portion 73*b*, which contacts the peripheral surface of the photosensitive drum 44*y*, a curvature which matches the curvature of the peripheral surface of the photosensitive drum 44*y*, and the reduction in this amount can prevent the separating portion 73*b* and/or photosensitive drum 44*y* from being damaged.

The present invention made it possible to reduce the amount of force necessary to remove a process cartridge covering member having a separating member, or separating portion, for keeping processing means separated from an image bearing member.

Further, the present invention can prevent an image bearing member and processing means from being damaged when a process cartridge covering member is removed.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 223400/2008 and 168888/2009 filed Sep. 1, 2008 and Jul. 17, 2009, respectively, which are hereby incorporated by reference.

What is claimed is:

1. A cartridge detachably mountable to a main assembly of an electrophotographic image forming apparatus, said cartridge comprising:

an image bearing member;

a frame;

process means contactable to and actable on said image bearing member;

a covering member mounted to said frame to protect a surface of said image bearing member and dismountable from said frame by moving in a direction crossing with an axis of said image bearing member; and a spacing portion provided on said covering member and inserted between said image bearing member and said process means to space said image bearing member and said process means from each other, said spacing portion being movable relative to said covering member while being interposed between said image bearing member and said process means when said covering member is removed from said frame.

2. A cartridge according to claim 1, wherein said spacing portion is rotatably engaged with said covering member.

3. A cartridge according to claim 1, wherein said spacing portion is mounted to said covering member by a hinge portion.

4. A cartridge according to claim 1, wherein said spacing portion is provided at each of one and the other axial ends of said image bearing member, which is a photosensitive drum.

5. A cartridge according to claim 1, wherein said spacing portion is detachably mounted to said covering member.

6. A cartridge according to claim 1, wherein said process means includes charging means for electrically charging said image bearing member.

7. A cartridge according to claim 6, wherein said charging means includes a rubber portion, and a shaft supporting said rubber portion rotatably relative to said frame, and wherein said spacing portion is inserted between the surface of said image bearing member and said shaft to space said image bearing member and said charging means from each other.

8. A cartridge according to claim 7, further comprising a pressing member for urging said charging means to said image bearing member.

9. A cartridge according to claim 1, wherein said process means includes developing means for developing an electrostatic latent image formed on said image bearing member.

10. A cartridge according to claim 9, wherein said developing means includes a rubber portion, and a shaft supporting said rubber portion rotatably relative to said frame, and wherein said spacing portion is inserted between the surface of said image bearing member and said shaft to space said image bearing member and said developing from each other.

11. A cartridge according to claim 10, further comprising a pressing member for urging said developing means to said image bearing member.

12. A cartridge according to claim 1, wherein said covering member includes a portion-to-be-locked for locking with said frame.

13. A cartridge according to claim 12, wherein said covering member is provided between a first portion-to-be-locked and a second portion-to-be-locked provided at one and the other axial ends of said image bearing member, which is a photosensitive drum, respectively.

14. A covering member for use with a cartridge detachably mountable to a main assembly of an electrophotographic image forming apparatus, the electrophotographic image forming apparatus including an image bearing member, a frame, process means contactable to and actable on the image bearing member, said covering member being, mounted to said frame to protect a surface of said image bearing member and being dismountable from said frame by moving in a direction crossing with an axis of said image bearing member, said covering member comprising:

a spacing portion provided on said covering member and inserted between said image bearing member and said process means to space said image bearing member and said process means from each other, said spacing portion being movable relative to said covering member while being interposed between said image bearing member and said process means when said covering member is removed from said frame.

15. A covering member according to claim 14, wherein said spacing portion is rotatably engaged with said covering member.

16. A covering member according to claim 14, wherein said spacing portion is mounted to said covering member by a hinge portion.

17. A covering member according to claim 14, wherein said spacing portion is provided at each of one and the other axial ends of said image bearing member which is a photosensitive drum.

18. A covering member according to claim 14, wherein said spacing portion is detachably mounted to said covering member.

19. A covering member according to claim 14, wherein said covering member includes a portion-to-be-locked for locking with said frame.

20. A covering member according to claim 14, wherein said covering member is provided between a first portion-to-be-locked and a second portion-to-be-locked provided at one and the other axial ends of said image bearing member, which is a photosensitive drum, respectively.

* * * * *